US011939787B2

(12) United States Patent
Michaelchuck et al.

(10) Patent No.: US 11,939,787 B2
(45) Date of Patent: Mar. 26, 2024

(54) RAPIDLY DEPLOYABLE STRUCTURES AND METHODS OF MAKING THE SAME

(71) Applicant: The Government of the United States, as represented by the Secretary of the Navy, Washington, DC (US)

(72) Inventors: Edward Michaelchuck, Alexandria, VA (US); Scott Ramsey, Fredericksburg, VA (US); Christopher Strem, Alexandria, VA (US)

(73) Assignee: The Government of the United States of America, as represented by the Secretary of the Navy, Arlington, VA (US)

( * ) Notice: Subject to any disclaimer, the term of this patent is extended or adjusted under 35 U.S.C. 154(b) by 125 days.

(21) Appl. No.: 17/386,513

(22) Filed: Jul. 27, 2021

(65) Prior Publication Data

US 2022/0025673 A1 Jan. 27, 2022

Related U.S. Application Data

(60) Provisional application No. 63/056,956, filed on Jul. 27, 2020.

(51) Int. Cl.

| | |
|---|---|
| ***E04H 15/28*** | (2006.01) |
| ***A45B 19/10*** | (2006.01) |
| ***A45B 25/02*** | (2006.01) |
| ***E04H 15/48*** | (2006.01) |
| *A45B 23/00* | (2006.01) |

(52) U.S. Cl.

CPC ..... *E04H 15/28* (2013.01); *A45B 19/10* (2013.01); *A45B 25/02* (2013.01); *E04H 15/48* (2013.01); *A45B 2023/0006* (2013.01)

(58) Field of Classification Search

CPC ..... A45B 19/10; A45B 25/02; E04H 15/28

See application file for complete search history.

(56) References Cited

U.S. PATENT DOCUMENTS

| | | | | |
|---|---|---|---|---|
| 1,797,993 A * | 3/1931 | Michaud | A45B 19/10 | 135/27 |
| 4,007,752 A * | 2/1977 | Weber | A45B 19/04 | 135/27 |
| 4,542,758 A * | 9/1985 | Okuda | A45B 25/02 | 135/25.3 |
| 5,235,997 A * | 8/1993 | Good | A45B 19/10 | 135/33.4 |

(Continued)

*Primary Examiner* — Noah Chandler Hawk

(74) *Attorney, Agent, or Firm* — US Naval Research Laboratory

(57) ABSTRACT

A rapidly deployable structure that includes a first and second hub, a plurality of legs and a rod connected to the first hub. The first hub includes first recesses. The second hub includes second recesses and an alignment guide. Each leg is connected to the first hub and the second hub. The rod connected is to the first hub and includes pins that are movable between an extended state, where pins protrude from the rod, and a retracted state where the pins are retracted within the rod. The first hub is movable relative to the second hub between a first state in which the rod is disposed above the alignment guide in an axial direction defined by an opening in the alignment guide and a second state in which a portion of the rod comprising the pins is below the alignment guide in the axial direction.

11 Claims, 37 Drawing Sheets

(56) References Cited

U.S. PATENT DOCUMENTS

| | | | | |
|---|---|---|---|---|
| 9,901,149 | B2 * | 2/2018 | Arndt | E04H 15/28 |
| 2003/0062077 | A1 * | 4/2003 | Lin | E04H 15/28<br>135/98 |
| 2012/0266928 | A1 * | 10/2012 | Lee | A45B 19/10<br>135/15.1 |
| 2018/0352921 | A1 * | 12/2018 | Arndt | A45B 19/12 |

* cited by examiner

RAPIDLY DEPLOYABLE STRUCTURES AND METHODS OF MAKING THE SAME

BACKGROUND

Field of the Invention

The present application relates generally to rapidly deployable structures and methods of making the same.

Description of Related Art

Shelter is a basic item one must have to survive. Shelters constructed from a frame and covering that attaches to the frame have been made for hundreds, if not thousands, of years. Many types of frame and covering structures are portable. Thus, unlike a traditional building that is set on a foundation and immovable, these types of frame and covering structures can be disassembled, moved to a different location, and reassembled. However, simply because it is possible to disassemble, move, and reassemble the structure does not mean it is easy. A typical frame and covering structure, e.g. a tent, takes several minutes if not an hour or more to setup. Though with practice one can become proficient at assembling their structure, there is a long felt need for compact, portable, structures that can be rapidly deployed at a desired location, and taken down in substantially the same amount of time. This need is especially present in certain applications, like a combat environment, where soldiers are seeking to gain concealment of their positions as quickly as possible.

SUMMARY OF THE INVENTION

One or more the above limitations may be diminished by structures and methods described herein.

In one embodiment, an apparatus comprising a first hub, a second hub, a plurality of legs and a rod connected to the first hub is provided. The first hub includes a first plurality of recesses. The second hub includes a second plurality of recesses and an alignment guide. Each of the plurality of legs is connected to the first hub and the second hub. The rod is connected to the first hub and comprises a plurality of pins that are movable between an extended state and a retracted state, wherein in the extended state pins protrude from the rod, and in a retracted state the pins retracted within the rod. The first hub is movable relative to the second hub between a first state in which the rod is disposed above the alignment guide in an axial direction defined by an opening in the alignment guide and a second state in which a portion of the rod comprising the plurality of pins is located below the alignment guide in the axial direction.

BRIEF DESCRIPTION OF THE DRAWINGS

The teachings claimed and/or described herein are further described in terms of exemplary embodiments. These exemplary embodiments are described in detail with reference to the drawings. These embodiments are non-limiting exemplary embodiments, in which like reference numerals represent similar structures throughout the several views of the drawings, and wherein:

Figure 1B:
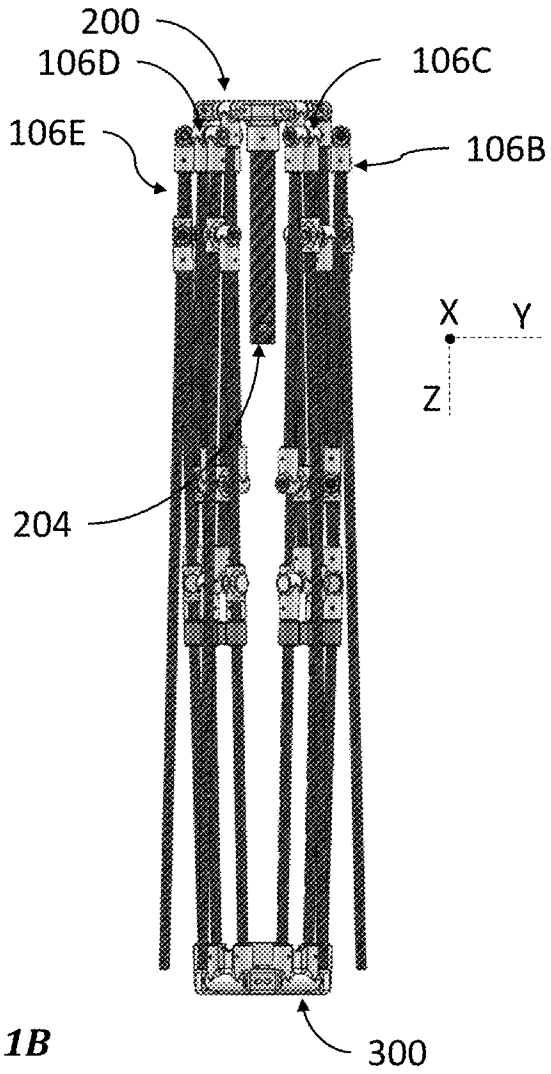
FIG. 1B is a side view of the folded structure 100 as viewed in the direction of the x-axis indicated in FIG. 1A.

Different ones of the Figures may have at least some reference numerals that are the same in order to identify the same components, although a detailed description of each such component may not be provided below with respect to each Figure.

DETAILED DESCRIPTION OF THE PREFERRED EMBODIMENTS

In accordance with example aspects described herein are deployable structures. This application claims priority to U.S. Provisional Patent Appln. No. 63/056,956, filed Jul. 27, 2020, the contents of which are incorporated by reference herein in their entirety.

Figure 1A:
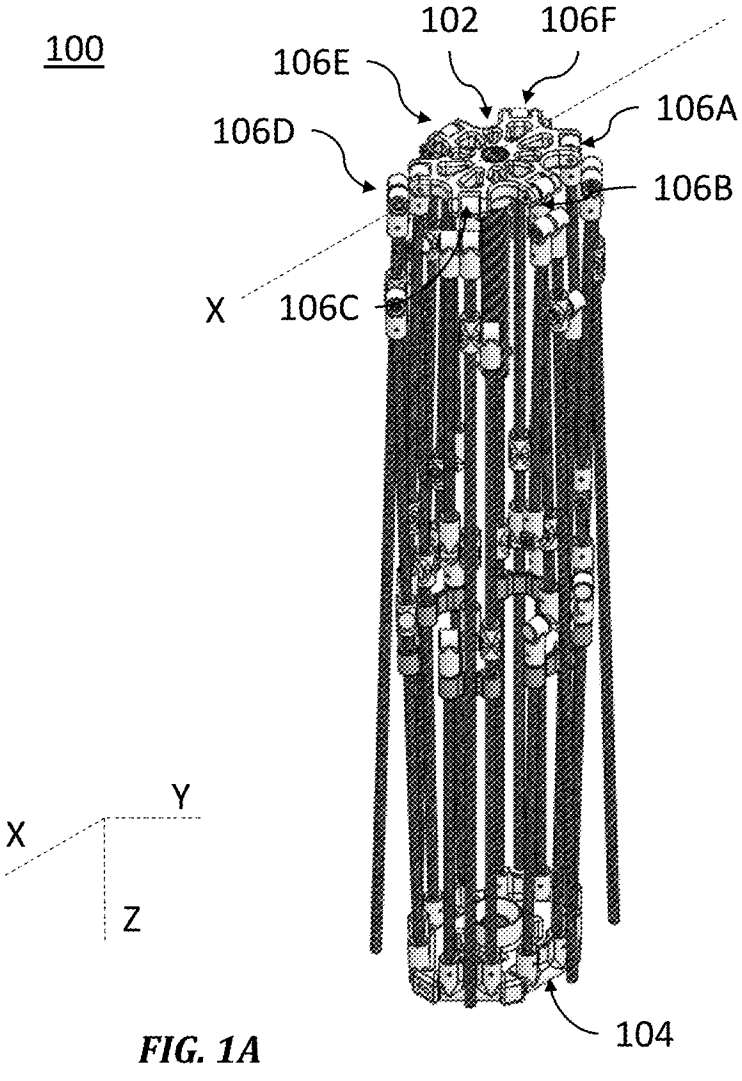
FIG. 1A is a perspective view of a structure 100 for supporting a covering.
Figure 18:
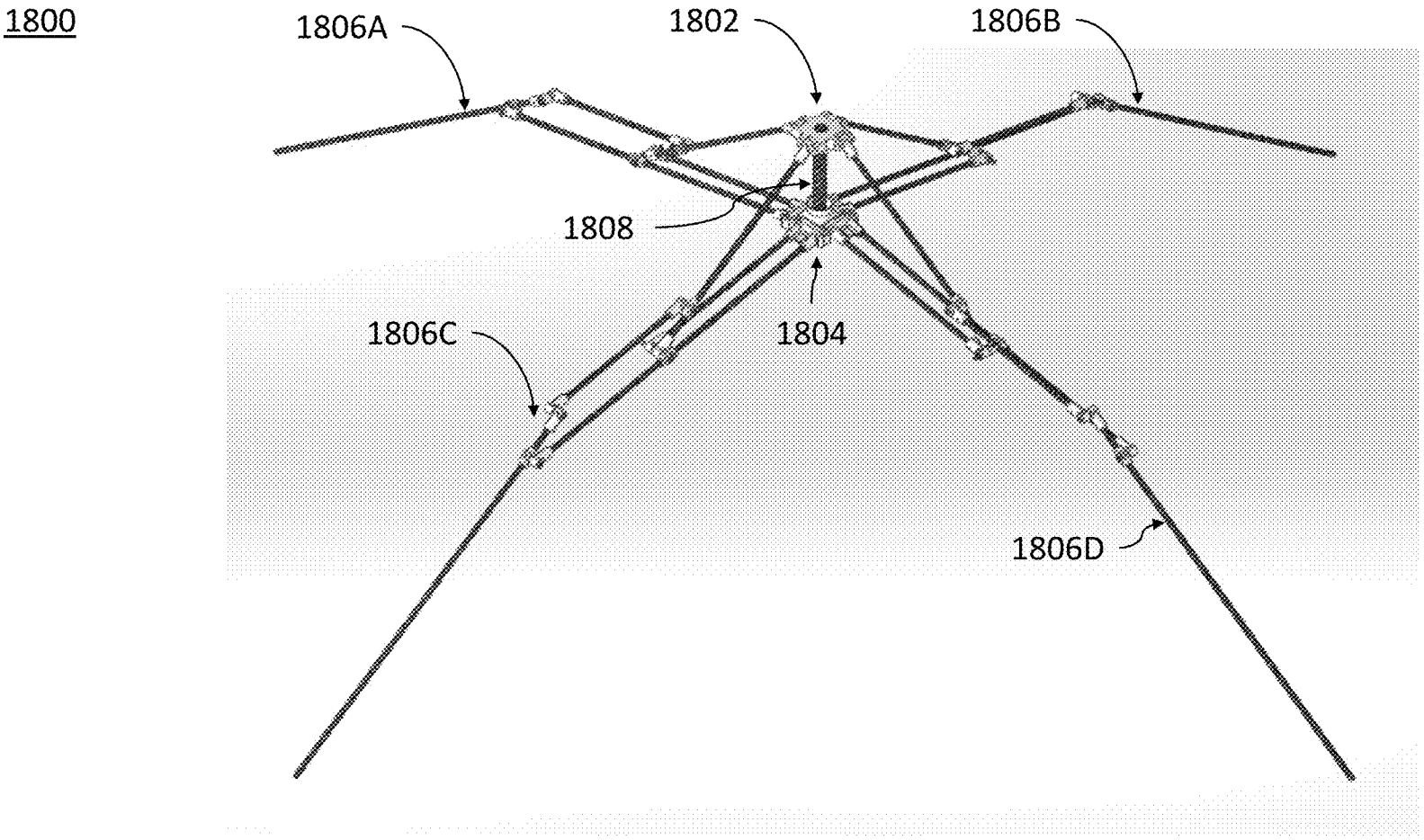
FIG. 18 is a perspective view of another structure 1800 comprising four legs.

FIG. 1A is a perspective view of a structure 100 for supporting a covering (not shown). As shown in FIG. 1A, structure 100 includes a top hub 102, a bottom hub 104, and a plurality of legs 106A-E. While six legs 106A-E are shown in FIG. 1A, this is merely exemplary. FIG. 18 shows another structure 1800 that comprises for legs 1806A-1806D. To ensure stability of the structure, at least three legs should be used; but any number of legs may be provided. Preferably, 3-8 legs are used. As more legs are used, the space between the legs decreases, thereby limiting the size of any entrances/exits that may be provided via openings in the covering. Additional legs also increase the weight of the structure, and since the structure is, in one embodiment, intended to be carried by a person, minimizing weight is an important factor. For brevity, a detailed description of structure 100 comprising six legs 106A-E is provided below. However, one of ordinary skill in the art will recognize that to accommodate more or less legs, one need only modify the top hub 102 and bottom 104 to have more or fewer recess for attaching the legs thereto.

FIG. 1A is an illustration of structure 100 in a folded state. As one of ordinary skill will appreciate, the folded state of structure 100 allows for the size of the structure to be reduced for easier transportation. FIG. 1B is a side view of the folded structure 100 as viewed in the direction of the x-axis indicated. As shown in FIG. 1B, a rod 204 is connected to the top hub 102. The details of rod 204 will be explained further below.

FIGS. 2A-D and 4A-D illustrate the process of deploying structure 100. In other words, the process by which structure 100 goes from a folded state to an extended state capable of supporting a covering. FIGS. 2A-D are perspective views of structure 100, whereas FIGS. 4A-D are side views in the direction of axis X in FIG. 2A. FIG. 3 is a plan view of structure 100 in an extended state. To deploy structure 100, a user may grasp the top hub 102 and lift structure 100. As explained below, in one embodiment, the materials comprising structure 100 are selected to have a strength-to-weight ratio sufficient to support an intended covering, while yielding an overall mass that is low enough to be easily lifted by an average adult. As the top hub 102 is lifted in a vertical direction, the weight of the plurality of legs 106A-E causes legs 106A-E to extend from their folded positions (as shown in FIGS. 1A and 1B) in a radial direction away from a central axis defined by rod 204. As legs 106A-E extend and move outward in a radial direction, the bottom hub 104 ascends in a vertical direction along the central axis (i.e., upward in FIGS. 2A-D). As the bottom hub 104 approaches the top hub 102, rod 204 engages an opening 706 in the bottom hub 104 and, as the top hub 102 and bottom hub 104 are brought closer together, rod 204 extends through the opening 706 in the bottom hub 104. This action is facilitated by the depression of pins 608-1 and 608-2 located on a portion of rod 104 that is distal from the top hub 102. Pins 608-1 and 608-2 made be manually depressed by the user or, in a preferred embodiment, are depressed by contacting an alignment guide 708, as described below. By depressing pins 608-1 and 608-2, pins 608-1 and 608-2 are retracted within rod 204 so that rod 204 may enter opening 706. Pins 608-1 and 608-2 are held in a retracted state by the sides of bottom hub 104 until the portion of rod 204 comprising pins 608-1 and 608-2 emerges through the opening 706 on an opposite side of hub 104. At this point, the sides of hub 104 no longer retain pins 608-1 and 608-2, and springs (not shown) cause the pins 608-1 and 608-2 to extend from rod 204 and enter an extended position.

Figure 2A:
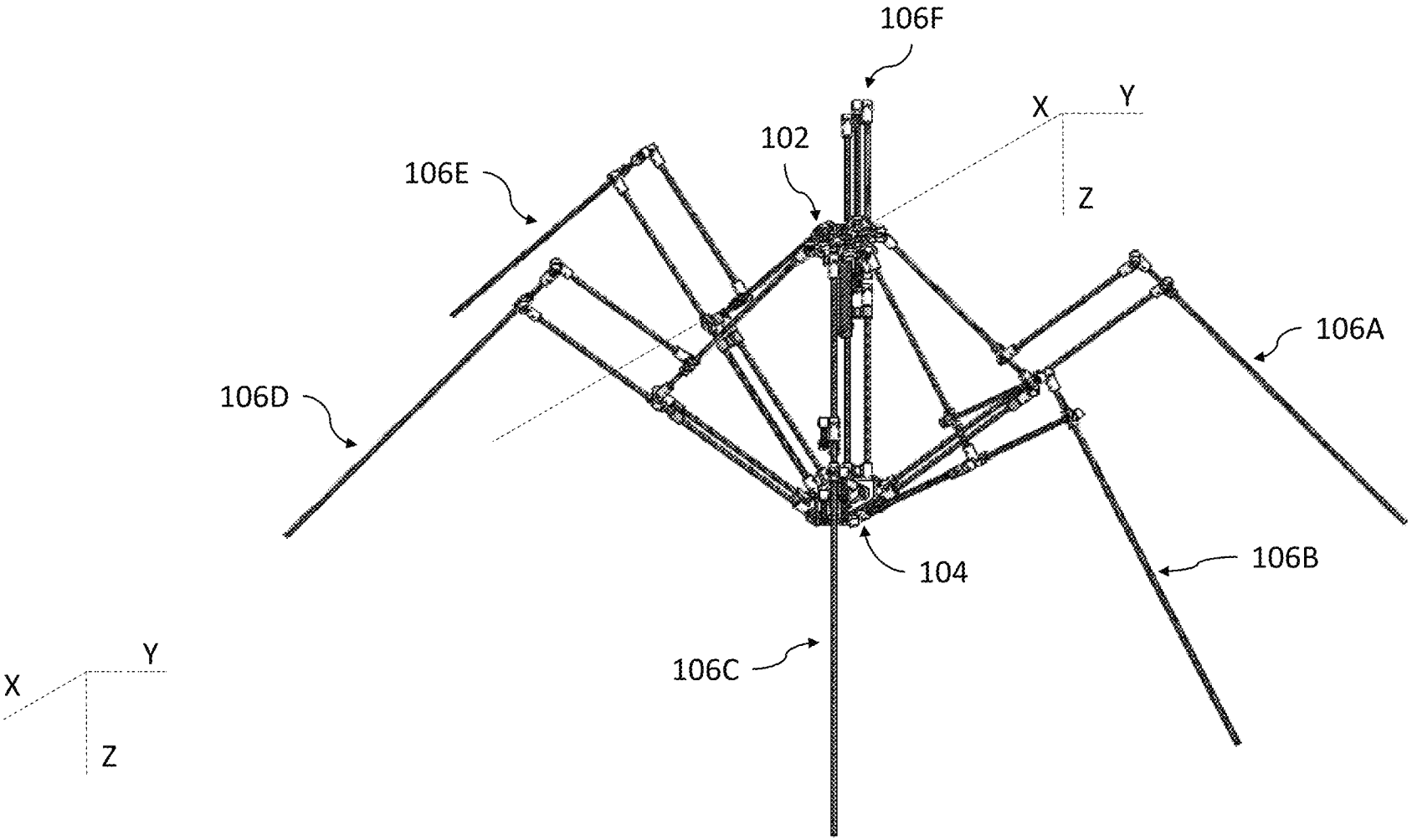
FIGS. 2A-D are perspective views of structure 100.
Figure 2B:
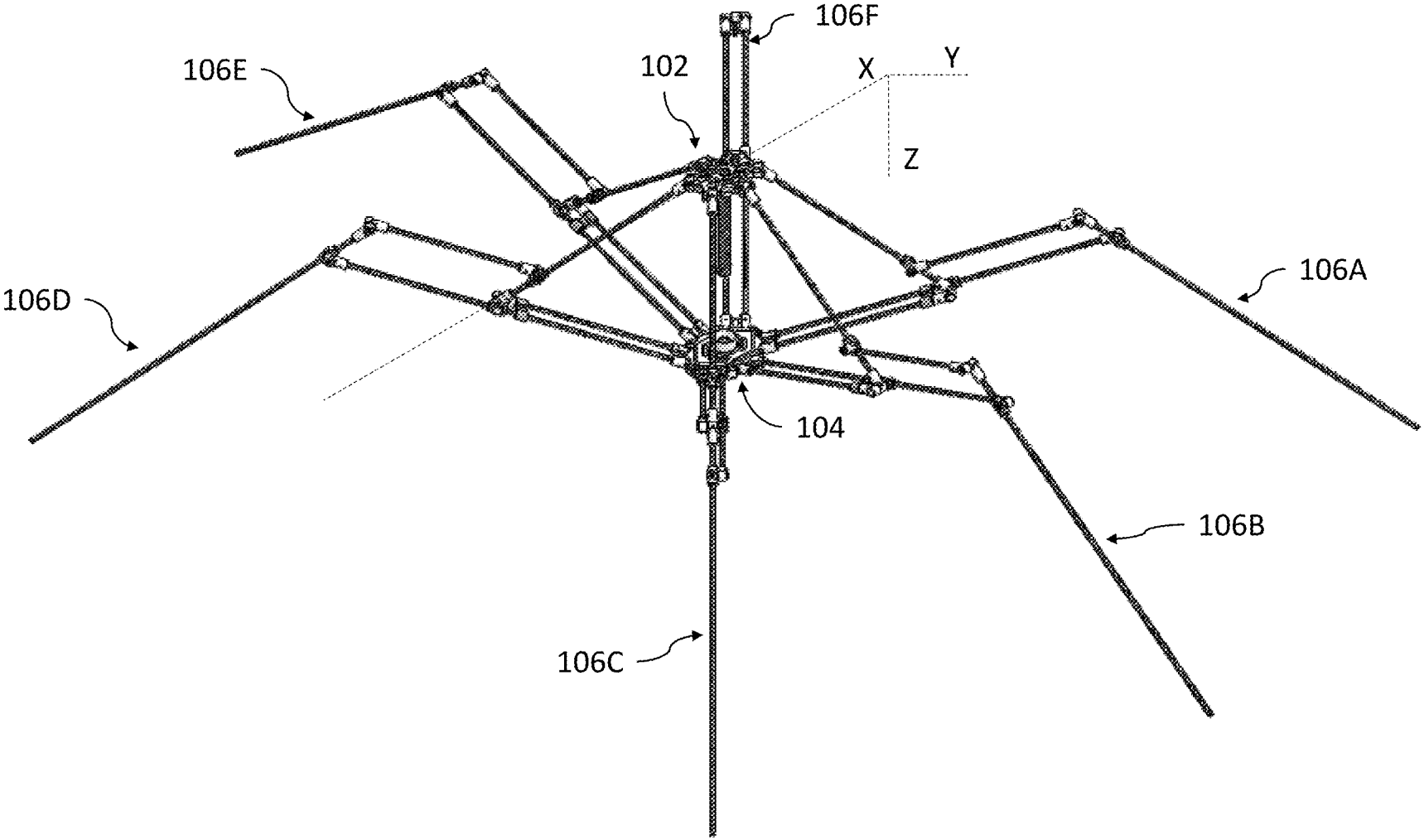
Figure 2C:
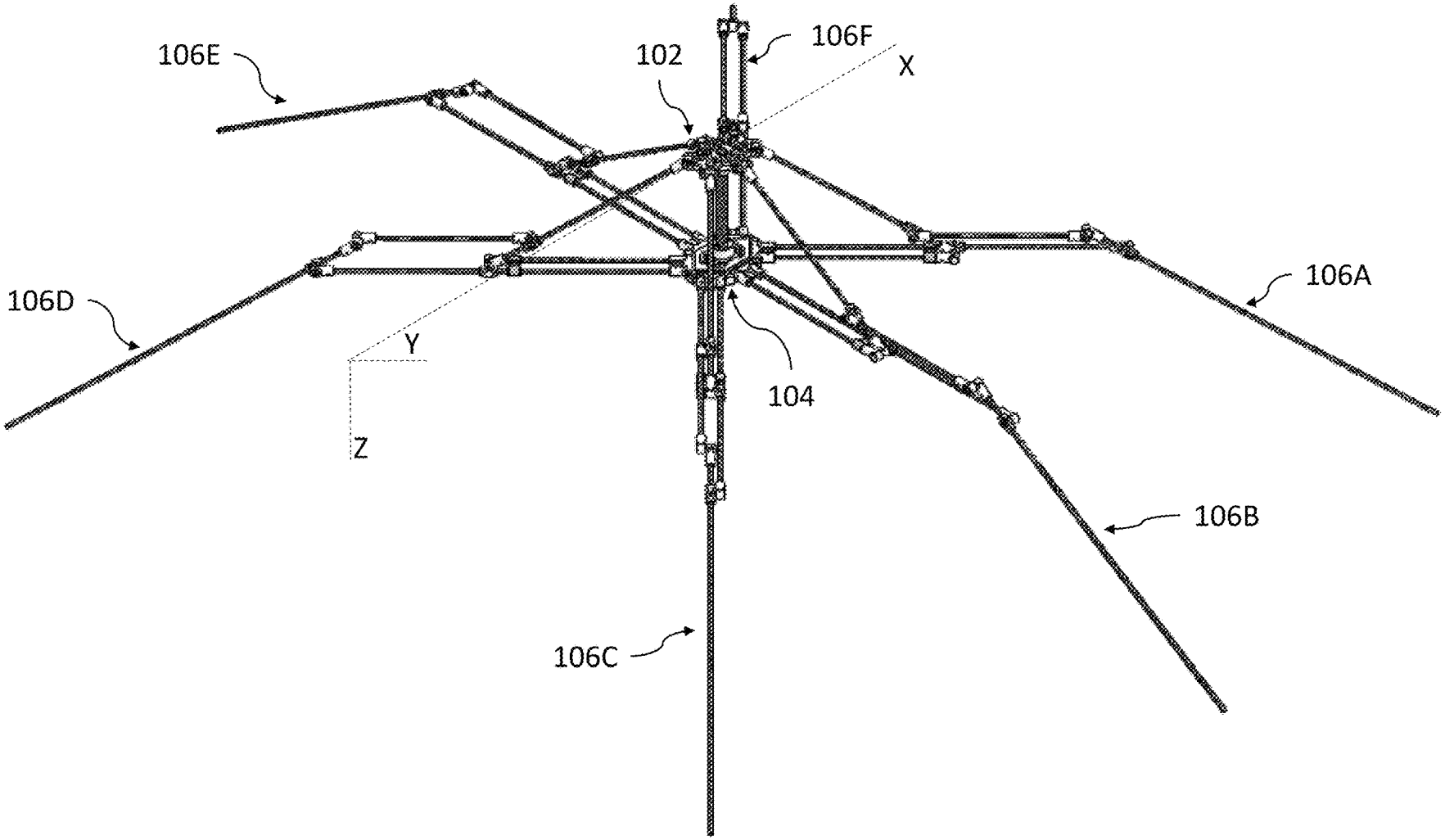
Figure 3:
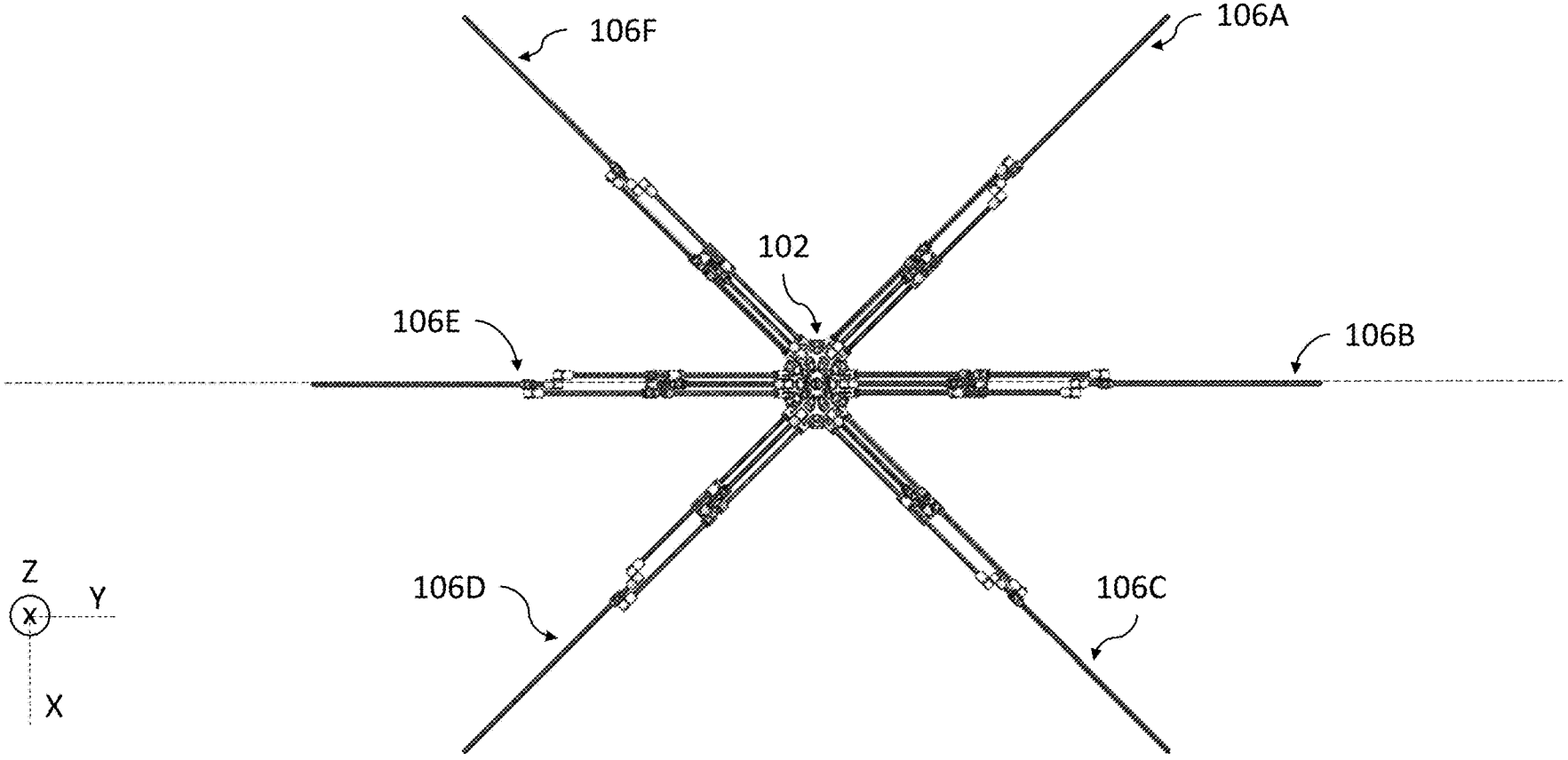
FIG. 3 is a plan view of structure 100 in an extended state.
Figure 4A:
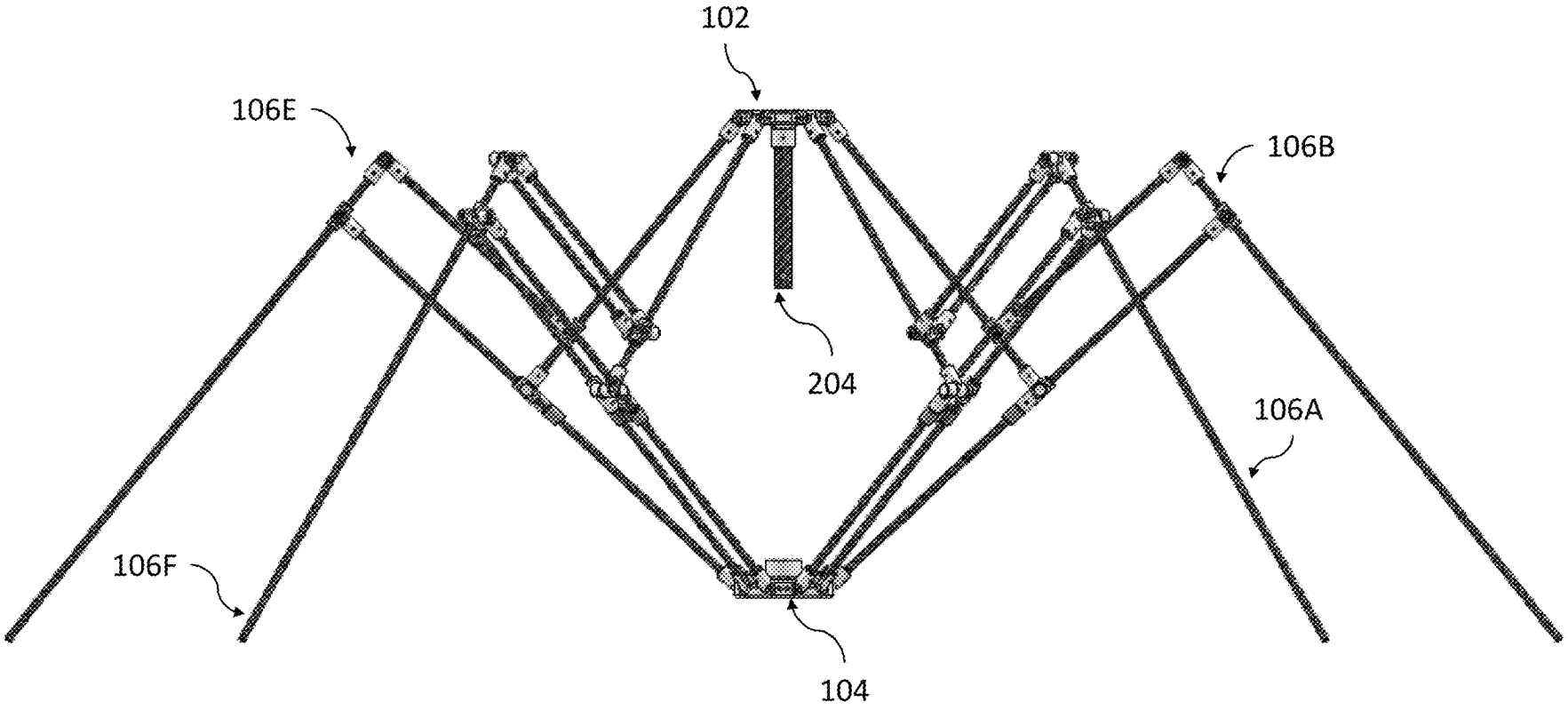
FIGS. 4A-D are side views of structure 100 as it transitions from a folded state to an extended state.
Figure 4B:
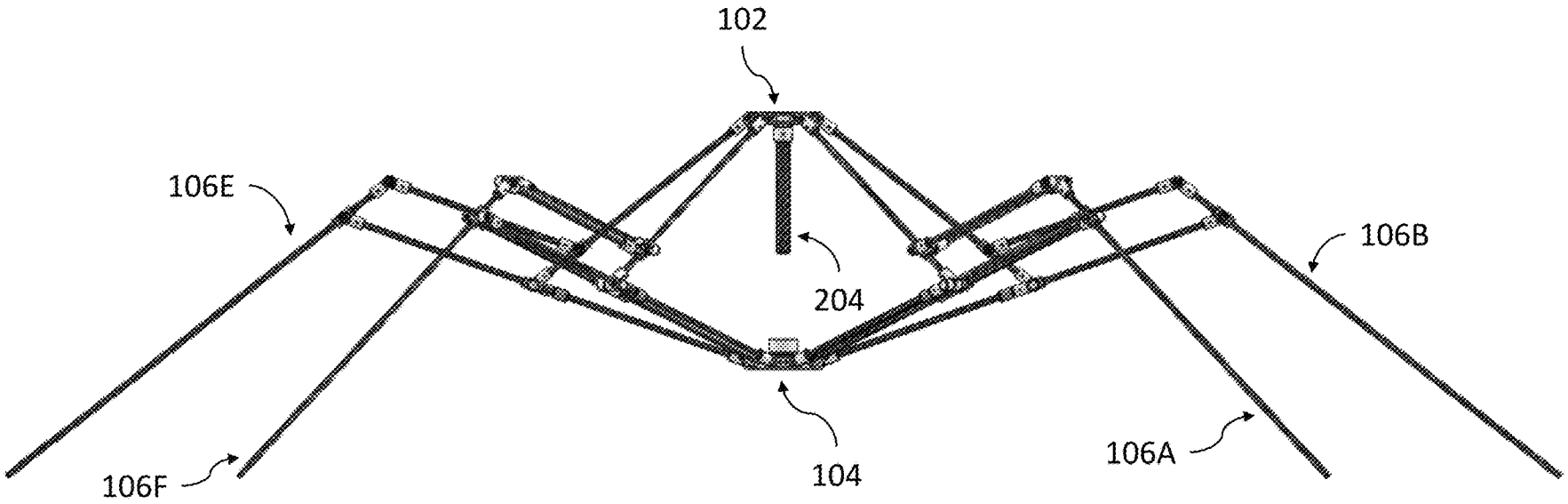
Figure 4C:
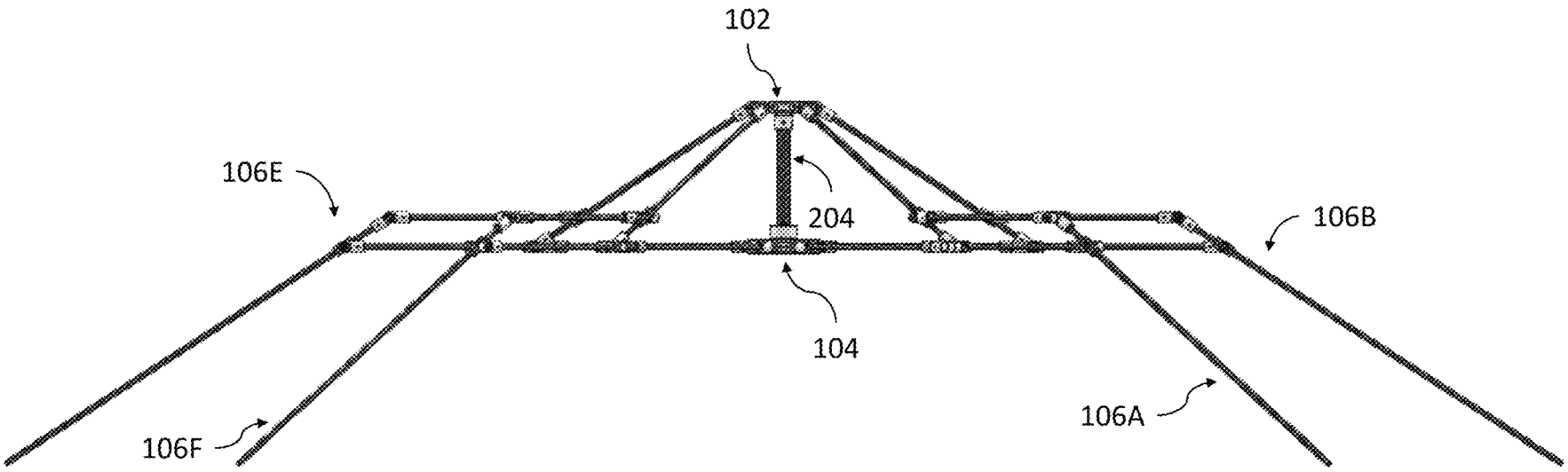

FIGS. 2C and 4C illustrate a state where rod 806 (see FIG. 8) of legs 106A-E forms a right angle to rod 204. In this state, the weight of legs 106A-E will not cause the bottom hub 104 to ascend further in relationship to the top hub 102. Rather, a user must lift the bottom hub 104 to allow the pins 608-1 and 608-2 to pass through the opening 706 such that the springs cause the pins 608-1 and 608-2 to extend into their extended position.

Figure 2D:
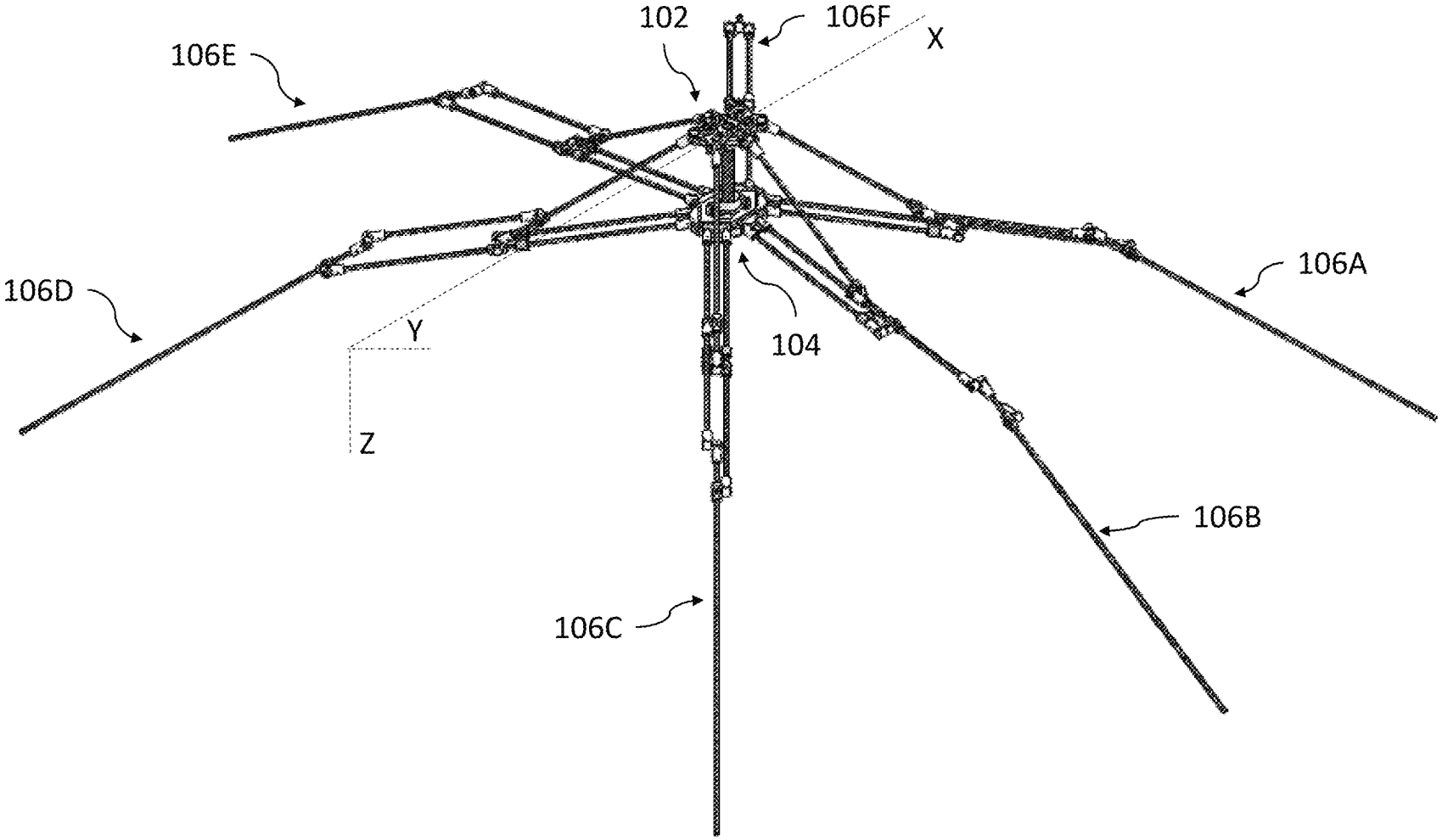
Figure 4D:
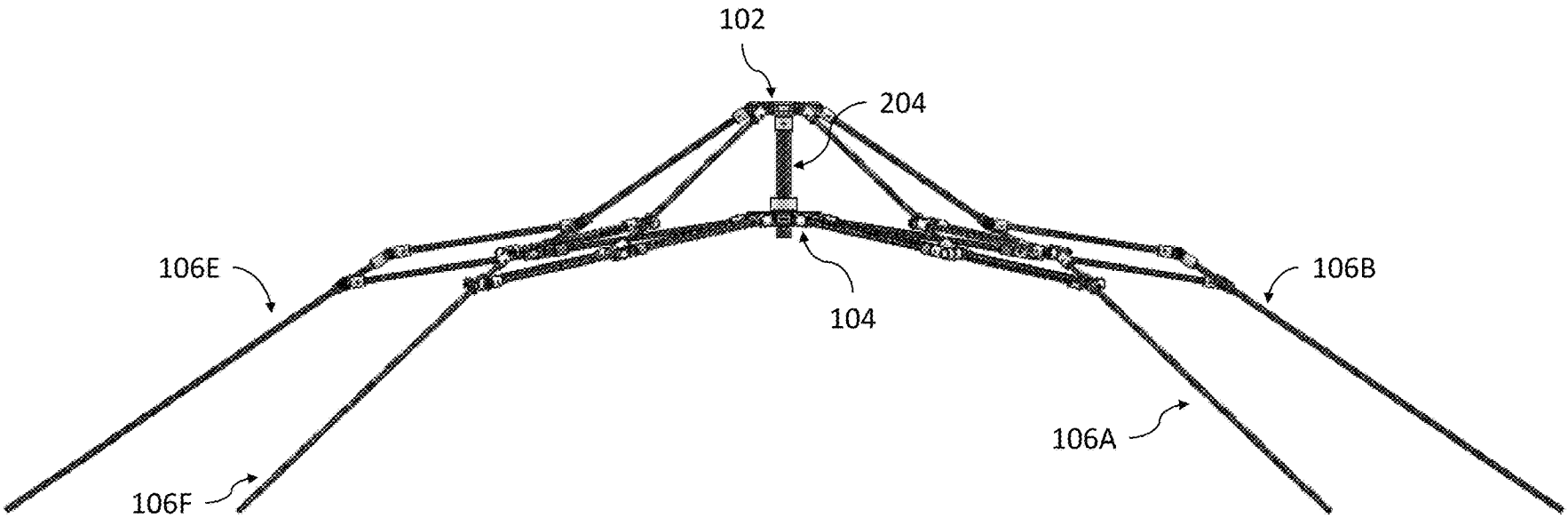
Figure 5:
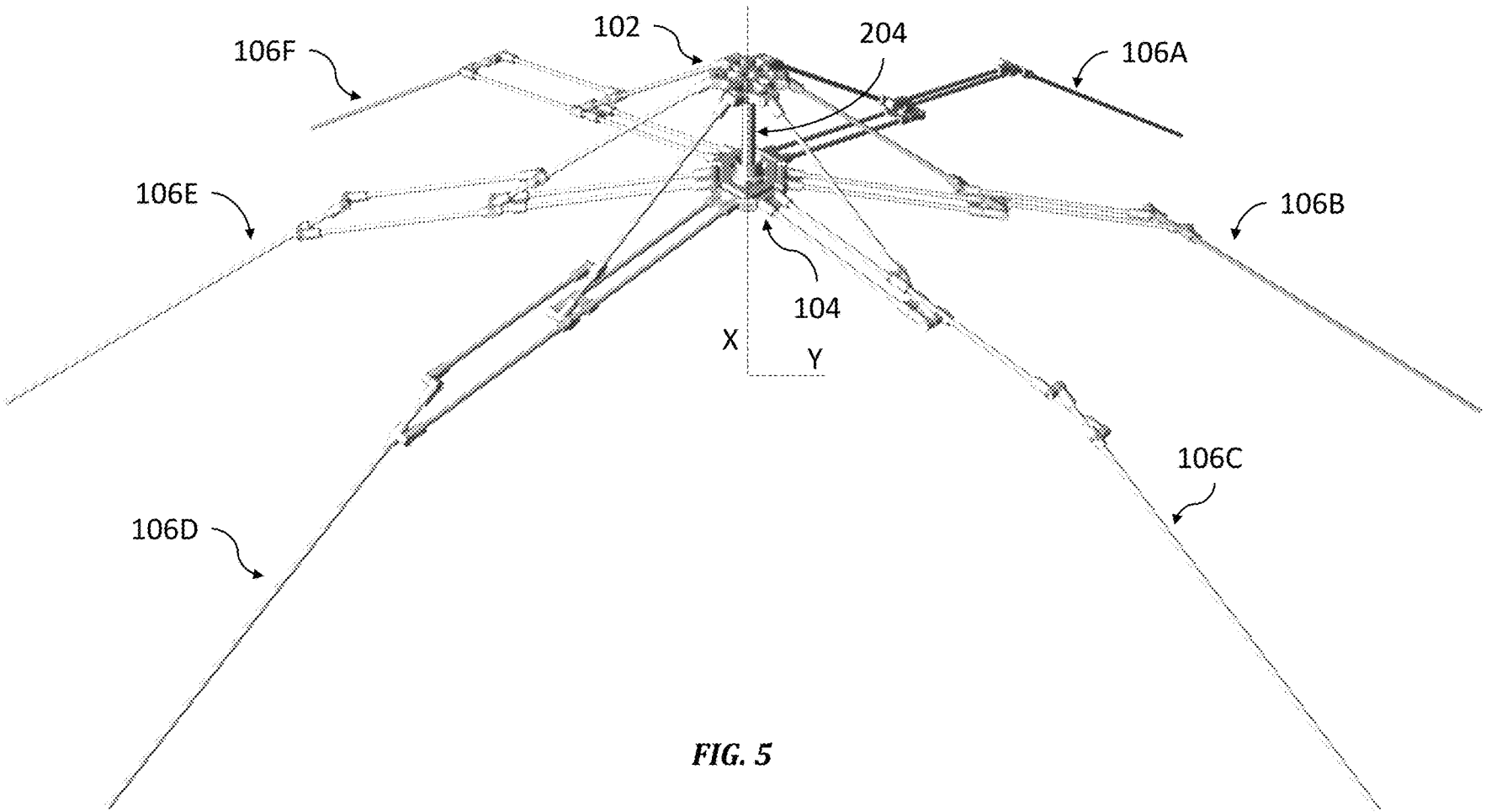
FIG. 5 is a perspective view of structure 100 taken along the x-axis from above.

FIGS. 2D and 4D illustrate the state where rod 204 has passed through opening 706 and pins 608-1 and 608-2 have entered their extended position. Gravity will now cause the bottom hub 104 to move downward such that a bottom surface of the bottom hub 104 will come to rest on the extended pins 608-1 and 608-2, as illustrated in FIG. 4D. Since pins 608-1 and 608-2 prevent the bottom hub 104 from descending any further, legs 106A-E are prevented from folding into their folded state and are thus locked in their extended positions. Structure 100 may now be placed on a surface and the distal ends of legs 106A-E will rest on that surface and remain in their extended position. To return structure 100 to a folded state from the extended state, a user may manually depress pins 608-1 and 608-2 such that they are retracted within rod 204. With the pins 608-1 and 608-2 in the retracted state, rod 204 is now free to move within opening 706 of the bottom hub 104. In fact, gravity will cause structure to move from an extended state, depicted in FIGS. 2D and 4D, to the partially extended state depicted in FIGS. 2C and 4C. To further collapse structure 100 such that it returns to the folded state depicted in FIGS. 1A and 1B, the user may pull the bottom hub 104 downward in a direction away from the top hub 102. This action causes the legs 106A-E to begin to fold inward towards the central axis defined by rod 204. By continuing to move the bottom hub 104 downward away from the top hub 102, structure 100 may be returned to the folded state. Having described the general operation of structure 100 and how its move between a folded state and an extended state, attention will now be directed to the details of the top hub 102, bottom hub 104, the plurality of legs A-E, rod 204, and their interoperability. FIG. 5 is a perspective view of structure 100 taken along the x-axis from above and will be used to explain features of structure 100 below.

Figure 6B:
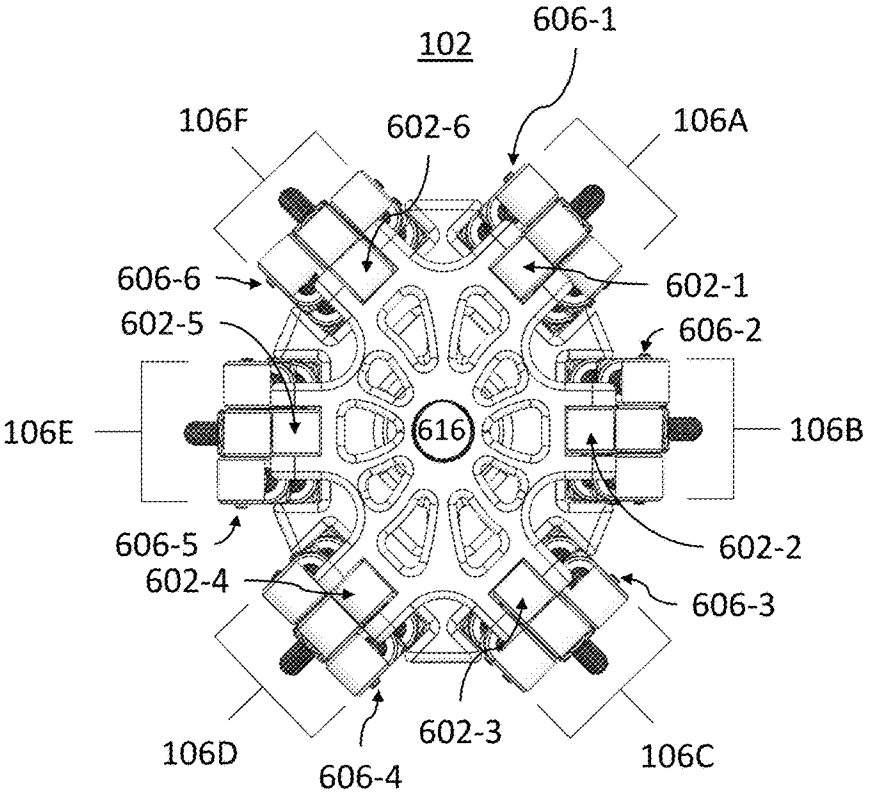
FIG. 6B is another plan view of hub 102.
Figure 6A:
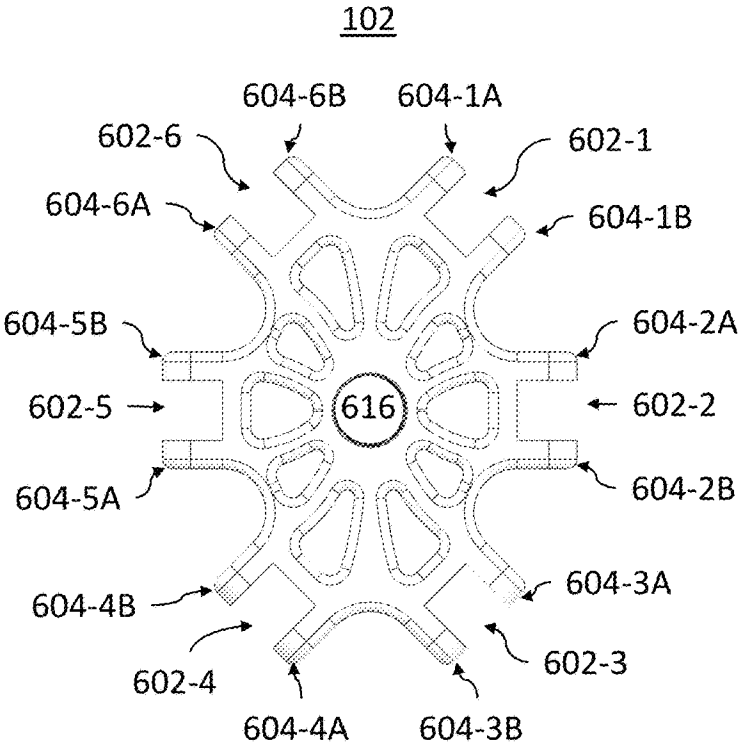
FIG. 6A is a plan view of the top hub 102 for a six-legged embodiment of structure 100.

FIG. 6A is a plan view of the top hub 102 for a six-leg embodiment of structure 100. The top hub 102 may be made of metal or a plastic based material, such as resin. In a preferred embodiment, the material has a high strength-to-weight ratio. Thus, for metal, aluminum, titanium, or alloys thereof are preferable. However, the cost of such materials may be prohibitive. In that case, high strength plastic materials such as resin may be used. In one embodiment, the top hub may be three-dimensional (3D) printed using resin which results in significant cost savings relative to metal. To minimize the weight of the object one or more voids, or open spaces, may be disposed around the periphery of a central opening 616. By carefully picking the number, size, shape, and location of these voids, the overall weight of the top hub 102 may be reduced without significantly comprising the strength of the top hub 102. The periphery of the top hub 102 includes a plurality of recesses 602-1 . . . 602-6 each of which is formed by two flanges 604-1A . . . 604-6A and 604-1B . . . 604-6B, respectively. Each of flanges 604-1A . . . 604-6A and 604-1B . . . 604-6B includes an opening extending from one side to the other to accommodate a pin 606-1 . . . 606-6 by which the plurality of legs 106A-E are connected to the top hub 102 at the recesses 602-1 . . . 602-6, respectively. The central opening 616 accommodates rod 204 which may be connected to the top hub 102 by a mechanical or chemical fastener.

FIG. 6B is another plan view of hub 102. In FIG. 6B, the plurality of legs 106A-E are respectively disposed within the recesses 602-1 . . . 602-6 and connected to the top hub 102 by pins 606-1 . . . 606-6 which have been inserted through and secured to the openings in the flanges 604-1A . . . 604-6A and 604-1B . . . 604-6B (see FIGS. 16B and 16C below).

Figure 6C:
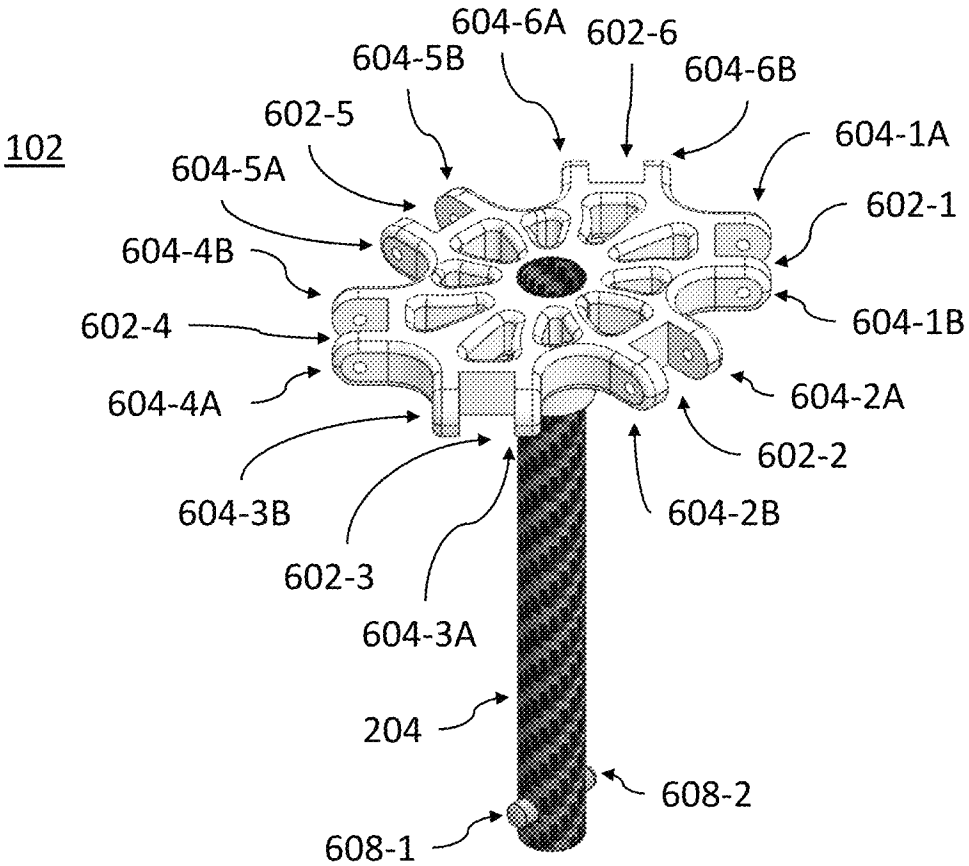
FIG. 6C is perspective view of top hub 102 and rod 204.

FIG. 6C is perspective view of top hub 102 and rod 204. As can be seen in FIG. 6C, one end of rod 204 is disposed within the central opening 616 of the top hub 102 and affixed thereto by a chemical fastener (e.g., glue, epoxy, or resin) or a mechanical fastener. Rod 204 may be constructed of metal, plastic, or carbon fiber. If a metal used, it is preferably aluminum, titanium, or alloys thereof to reduce overall weight. In the exemplary embodiment shown in FIG. 6C, rod 204 comprises carbon fiber which provides advantageous strength-to-weight properties. FIG. 6C also shows pins 608-1 and 608-2 protruding from rod 204 proximate to another end of rod 204 that is distal from the top hub 102. As discussed above, pins 608-1 and 608-2 are spring loaded such that pins 608-1 and 608-2 are normally in an extended position projecting from a surface of rod 204. However, the force of the springs may be overcome by a user manually depressing pins 608-1 and 608-2 causing them to retract with an interior portion of rod 204.

Figure 7B:
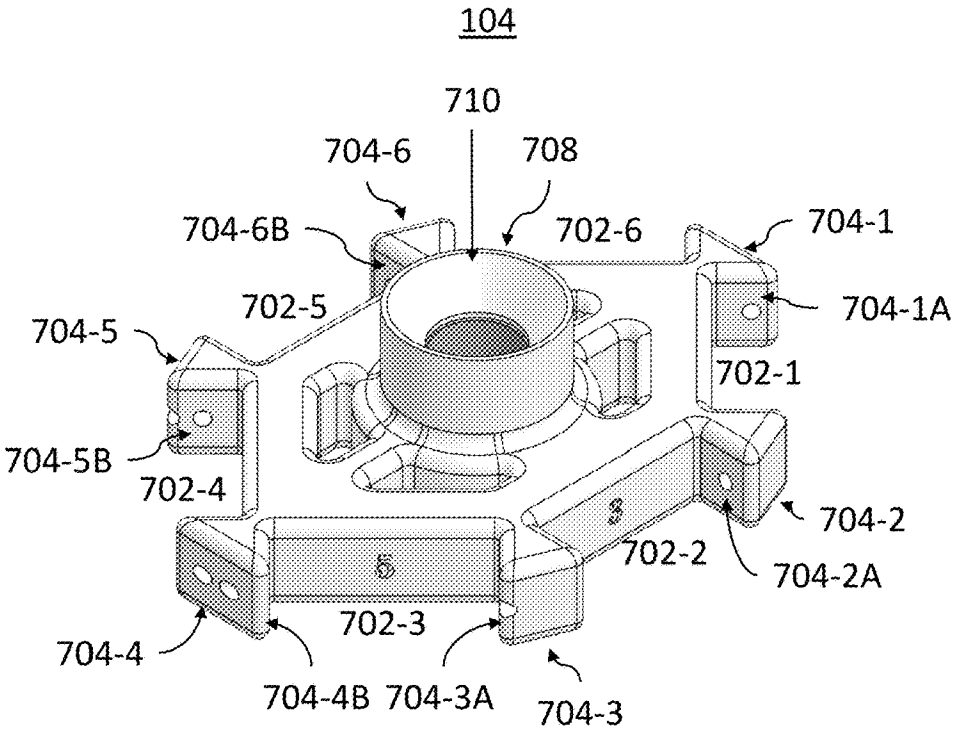
FIG. 7B is a perspective view of the bottom hub 104 for a six-legged embodiment of structure 100.
Figure 7A:
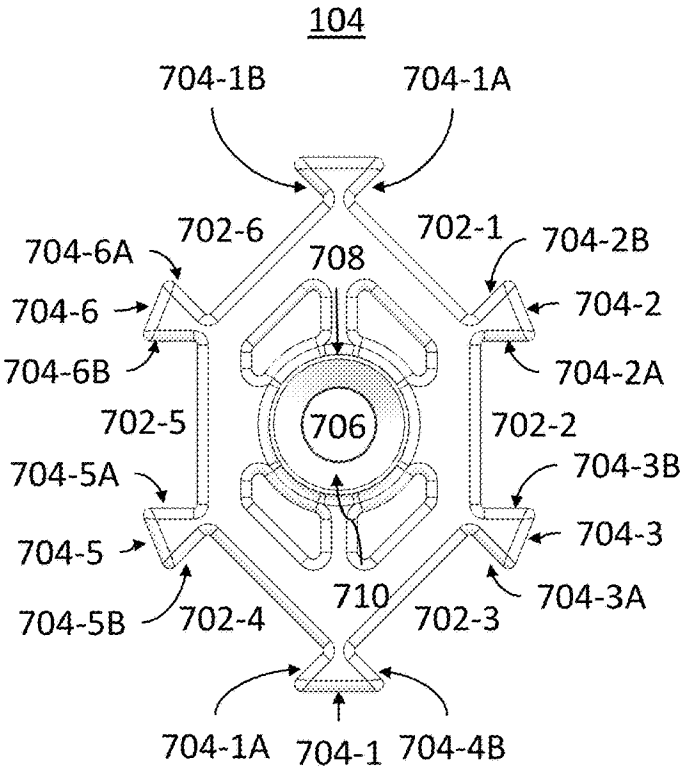
FIG. 7A is a plan view of the bottom hub 104 for a six-legged embodiment of structure 100.

FIG. 7A is a plan view of the bottom hub 104 for a six-legged embodiment of structure 100. FIG. 7B is a perspective view of the bottom hub 104 for a six-legged embodiment of structure 100. As shown in FIG. 7A, the bottom hub 104 comprises a plurality of recesses 702-1 . . . 702-6. As discussed below, the plurality of recesses 702-1 . . . 702-6 are for receiving the lower coupling mechanism 816 of the plurality of legs 106A-F, respectively, and connecting them to the bottom hub 104. Each of the plurality of recesses 702-1 . . . 702-6 is defined two of a plurality of protrusions 704-1 . . . 704-6 extending generally away from an opening 706 for receiving rod 204. Thus, as illustrated in FIG. 7B, recess 702-3 is defined by a sidewall 704-3A of protrusion 704-3 and a sidewall 704-4B of protrusion 704-4. Each of the plurality of sidewalls 704-1A . . . 704-6A and 704-1B . . . 704-6B has an opening (e.g., 712-3A and 712-3B in FIGS. 16B and 16C) formed in a surface thereof that is sized and shaped to receive a pin that connects a corresponding leg of the plurality of legs 106A-E to the bottom hub 104.

As shown in FIG. 7B, the central portion of the bottom hub 104 includes an opening 706 for receiving rod 204. In a preferred embodiment, above the opening 706 is an alignment guide 708. The alignment guide 708 has two diameters: a peripheral diameter and an interior diameter which is equal to the diameter of opening 706. The interior diameter is greater than the diameter of rod 204 to allow rod 204 to pass through the bottom hub 104. However, if the interior diameter of the alignment guide 708 is much larger than the diameter of rod 204, then rod 204 may be deflected within opening 706. Therefore, in a preferred embodiment, the diameter of the opening 706 is greater by approximately 1-5% of the diameter of rod 204. The peripheral diameter of the alignment guide 708 is greater than the interior diameter by between 10-25%. This allows the periphery of the alignment guide 708 to extend well beyond the diameter of rod 204 such that if rod 204 deviates from a central axis defined by opening 706, rod 204 may contact a surface 710 of the alignment guide 708 located between the opening 706 and the periphery of the alignment guide 708. Surface 710 may, as shown in FIG. 7B, be a concave surface such that if rod 204 contacts surface 710 the contacting portion of rod 204 is deflected towards opening 706. This configuration ensures that even if the rod 204 is deviates slightly from the central axis defined by opening 706 during the deployment of structure 100, that the rod 204 may be guided through the opening 706 in the bottom hub 104. Surface 710 also, in a preferred embodiment, serves another purpose besides ensuring the alignment of rod 204 and opening 706. As rod 204 and bottom hub 104 move relatively towards one another, pins 608-1 and 608-2 will come into contact with surface 710. The weight of structure 100 caused by the force of gravity provides sufficient force for surface 710 to force pins 608-1 and 608-2 into a retracted state within rod 204. This avoids the user having to manually depress pins 608-1 and 608-2 prior to their engagement with the bottom hub 104. Having explained the structure, configuration, and operation of the top hub 102, bottom hub 104, and rod 204, attention will now be directed to the plurality of legs 106A-E.

In a preferred embodiment, each of the plurality of legs 106A-E are the same. Thus, for brevity, a detailed description of a single exemplary leg 106 will be given below.

Figure 8:
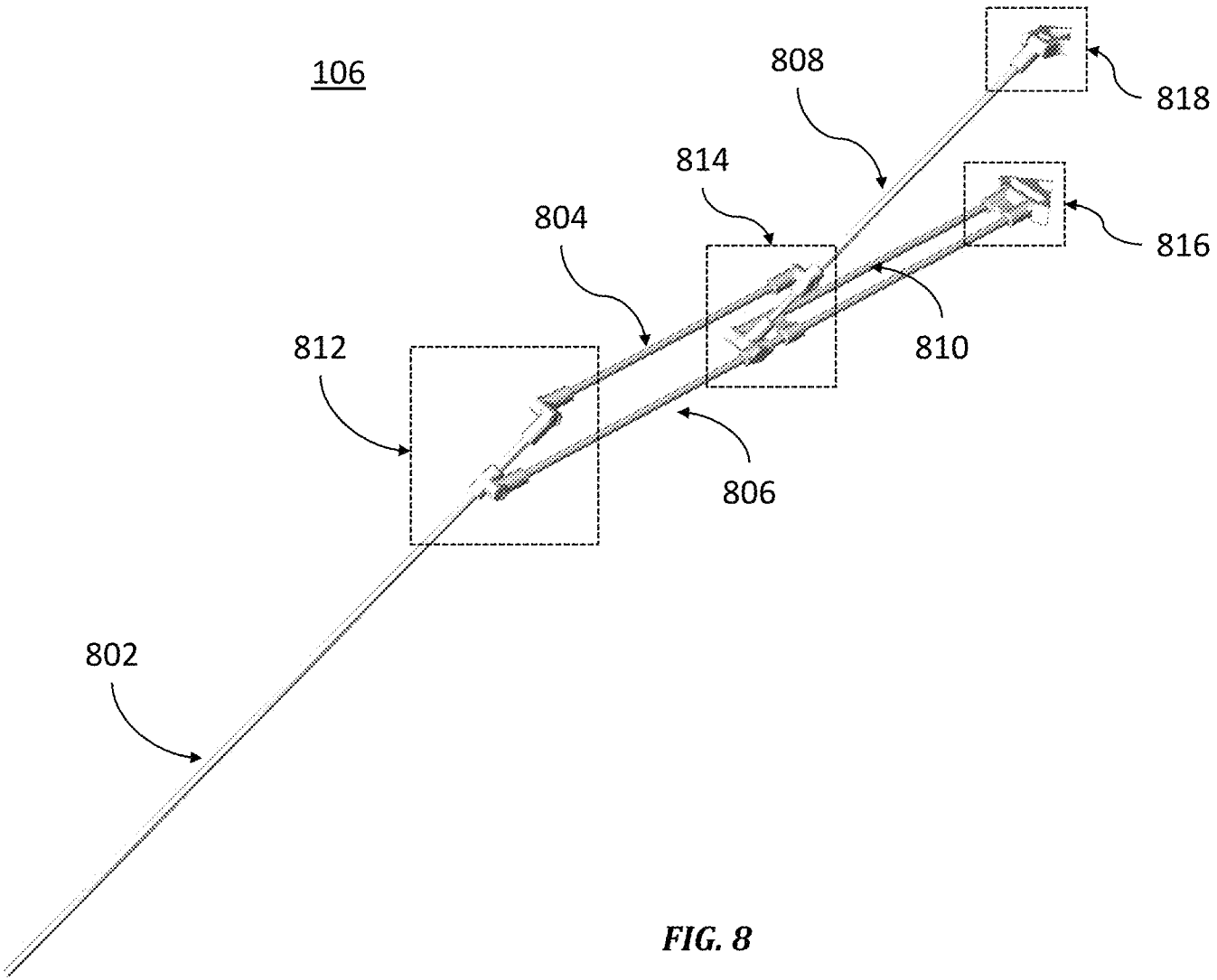
FIG. 8 is a perspective view of an exemplary leg 106.

FIG. 8 is a perspective view of an exemplary leg 106 according to one embodiment. Leg 106 is formed by a plurality of rods 802, 804, 806, 808, and 810 that are connected to each other via a lower pivoting mechanism 812 and an upper pivoting mechanism 814. Leg 106 connects to the top hub 102 via a top coupling mechanism 818 and a lower coupling mechanism 816. The pivoting mechanisms 812 and 814 and the coupling mechanisms 816 and 818 will be discussed below in detail.

Figure 9:
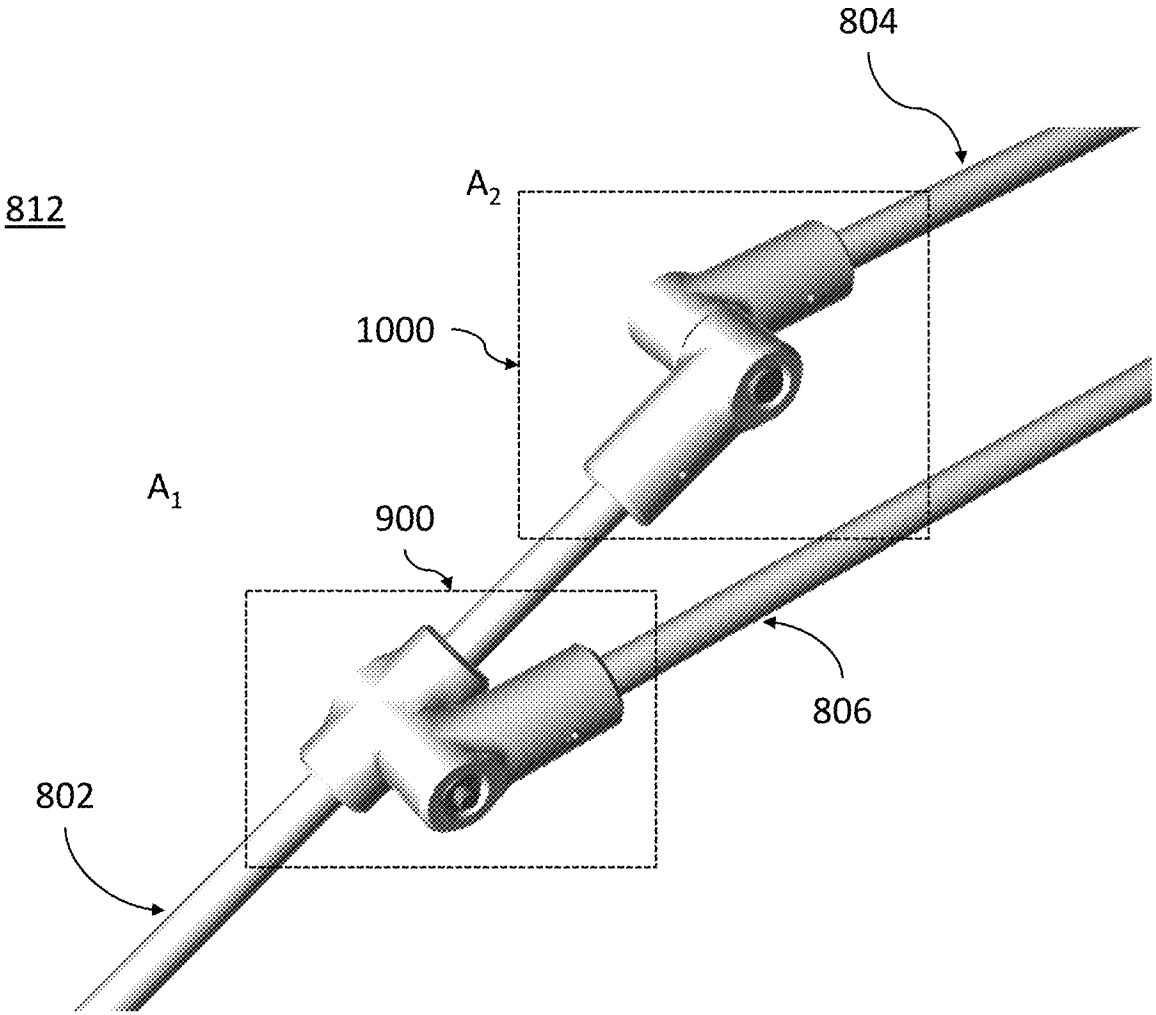
FIG. 9 is a perspective view of the lower pivoting mechanism 812 shown in FIG. 8.
Figure 10A:
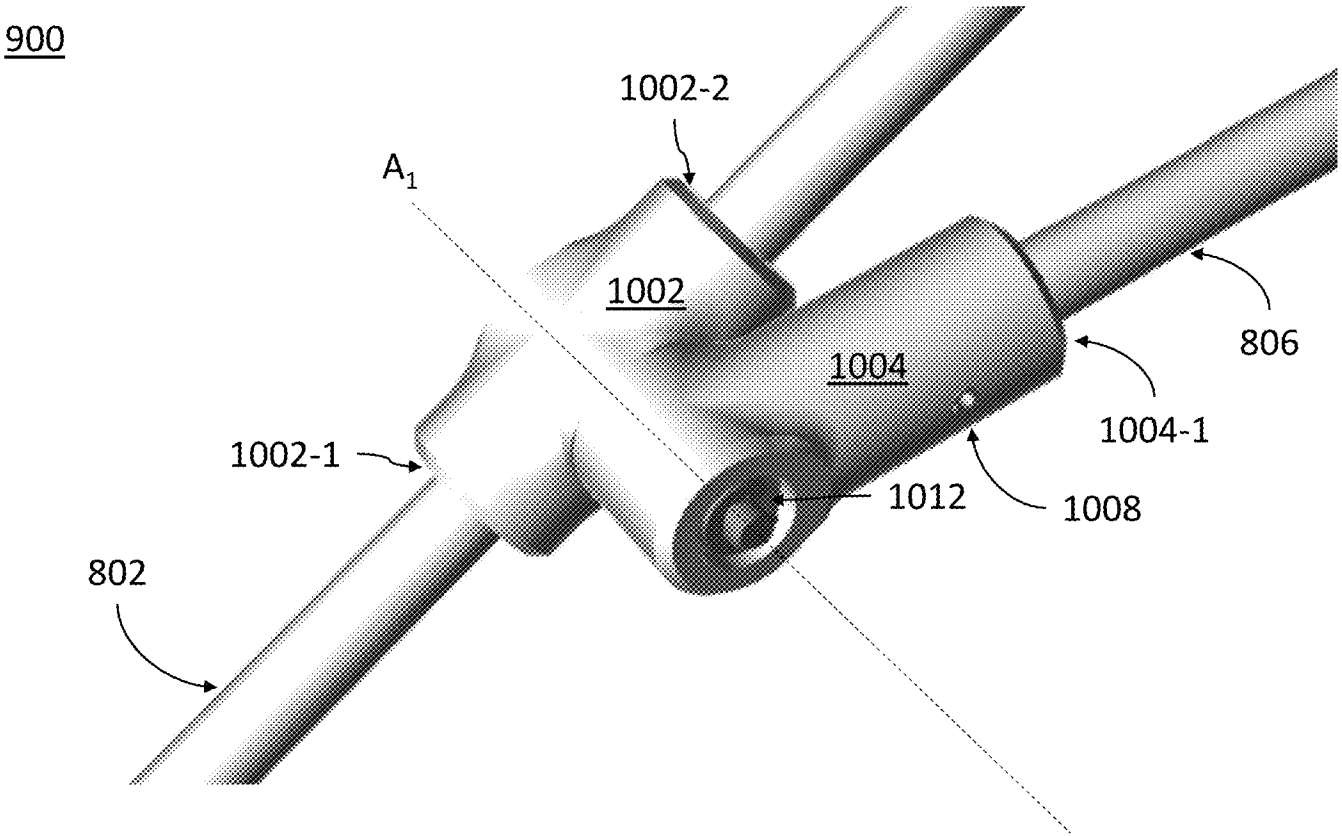
FIG. 10A is a perspective view of the assembled lower joint 900.
Figure 10B:
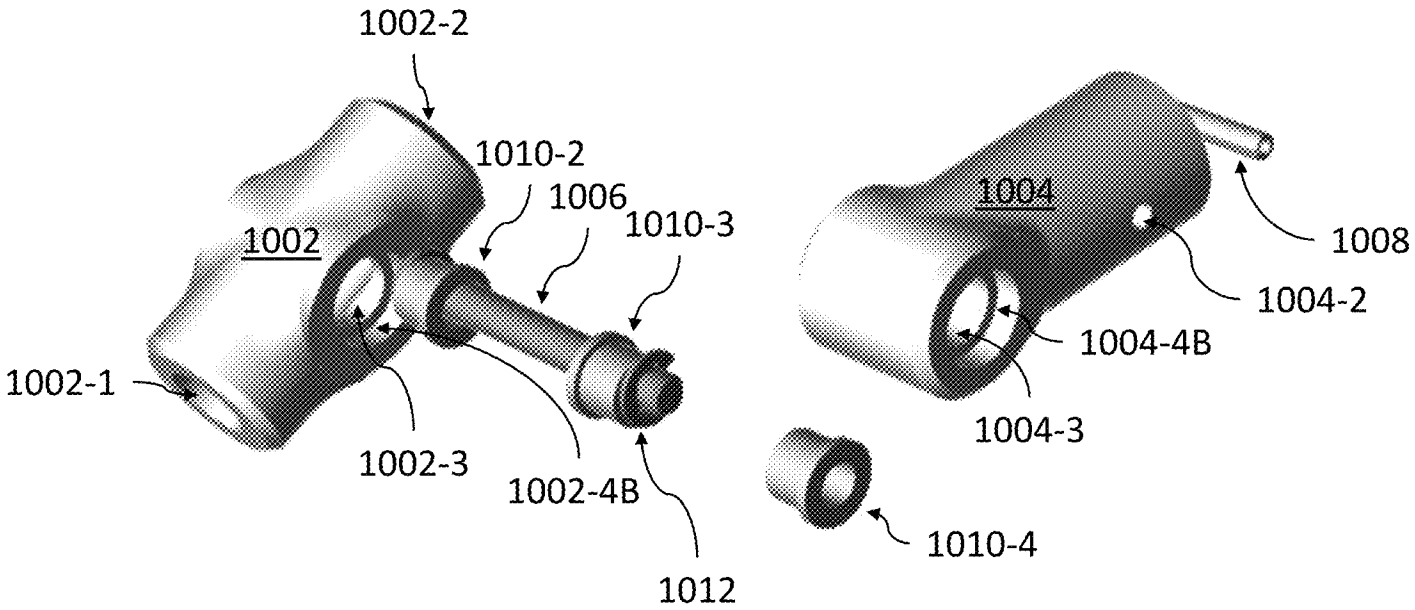
FIGS. 10B and 10C are exploded side perspective views of components comprising the lower joint 900.
Figure 10C:
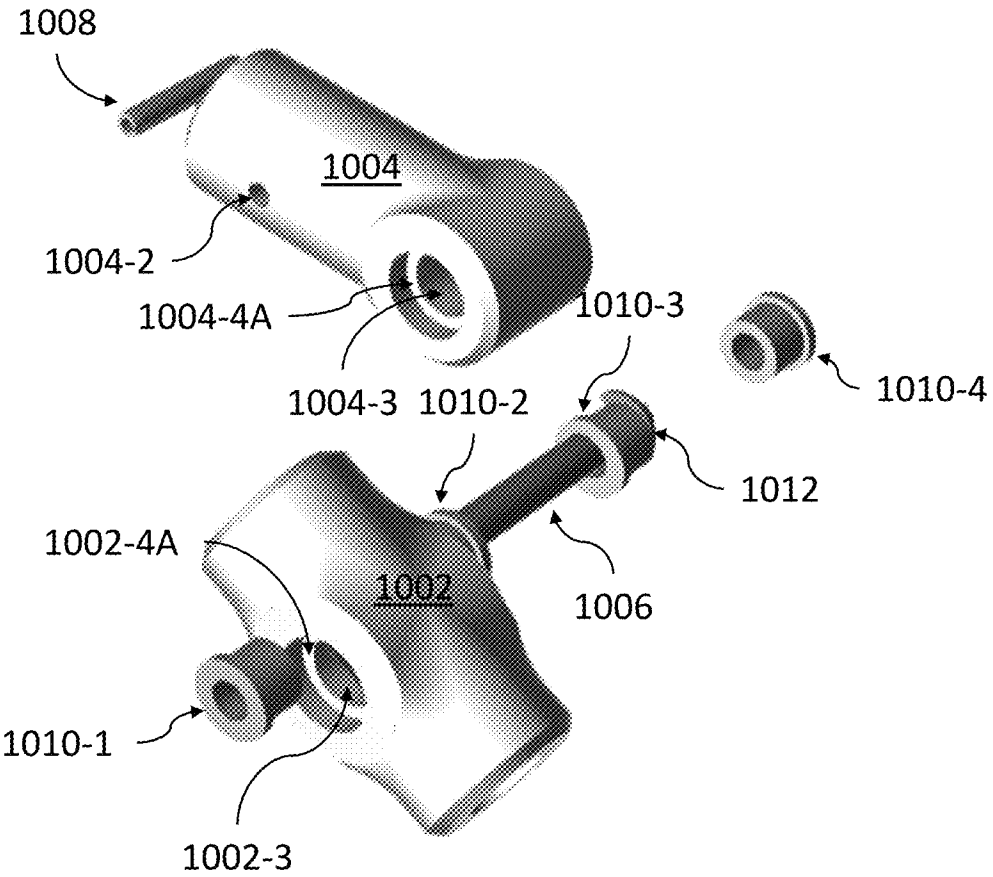

FIG. 9 is a perspective view of the lower pivoting mechanism 812 shown in FIG. 8. The lower pivoting mechanism 812 includes a lower joint 900 and an upper joint 1000, the details of which are shown in FIGS. 10A-C and 11A-C, respectively. Beginning with the lower joint 900, FIG. 10A is a perspective view of the assembled lower joint 900. FIGS. 10B and 10C are exploded side perspective views of the lower joint 900 which are presented to illustrate components not visible in the assembled lower joint 900 shown in FIG. 10A.

As shown in FIG. 10A, rod 802 is engaged to a pass-through coupler 1002. As one of ordinary skill will appreciate, rod 802 is intended to contact a surface on which structure 100 is deployed. As such, the connection between rod 802 and the pass-through coupler 1002 should be secure. To achieve that, rod 802 passes through the pass-through coupler 1002 and into receptacle 1102-1 of coupler 1102, described below.

When rod 802 is fully into receptacle 1102-1 and properly aligned, an opening in rod 802 (not shown) becomes coaxial (along axis $A_1$) with an opening 1002-3 in the pass-through coupler 1002 such that connecting pin 1006 may be inserted through coupler 1002 and rod 802 thereby forming a mechanical connection between the pass-through coupler 1002 and rod 802. As shown in FIGS. 10B and 10C, the pass-through coupler 1002 includes flanges 1002-4A and 1002-4B for mounting bushings 1010-1 and 1010-2, respectively, through which the connecting pin 1006 passes. Connecting pin 1006 also passes through bushing 1010-3 and retaining ring 1012 before entering opening 1004-3 of rotational coupler 1004 in the axial direction $A_1$.

As shown in FIGS. 10A-C, a rotational coupler 1004 is also provided in the lower joint 900 of the lower pivoting mechanism 812. Rotational coupler 1004 includes a receptacle 1004-1 for receiving rod 806. Rod 806 preferably contacts a stop located within receptacle 1004-1 that aids in aligning an opening 1004-2 in the rotational coupler 1004 and a corresponding opening in rod 806 such that pin 1008 may be inserted through such openings to mechanically secure rod 806 to the rotational coupler 1004. Of course, as one of ordinary skill will appreciate, a chemical fastener may also be used to reinforce the mechanical connection by pin 1008, or in lieu thereof. At an opposite end of the rotational coupler 1004 from the receptacle 1004-1 is an annular section that includes an opening 1004-3, and flanges 1004-4A and 1004-4B. Flange 1004-4A is constructed to receive bushing 1010-3 while flange 1004-4B is constructed to receive bushing 1010-4. Connecting pin 1006 is then inserted through the opening 1004-3 and the bushings 1004-4A and 1004-4B. This establishes a rotational connection between the pass-through coupler 1002 and the rotational coupler 1004 to provide relative rotation therebetween. Having described the lower joint 900 of the lower pivoting mechanism 812, attention will now be directed to the upper joint 1000 as illustrated in FIGS. 11A-C.

Figure 11A:
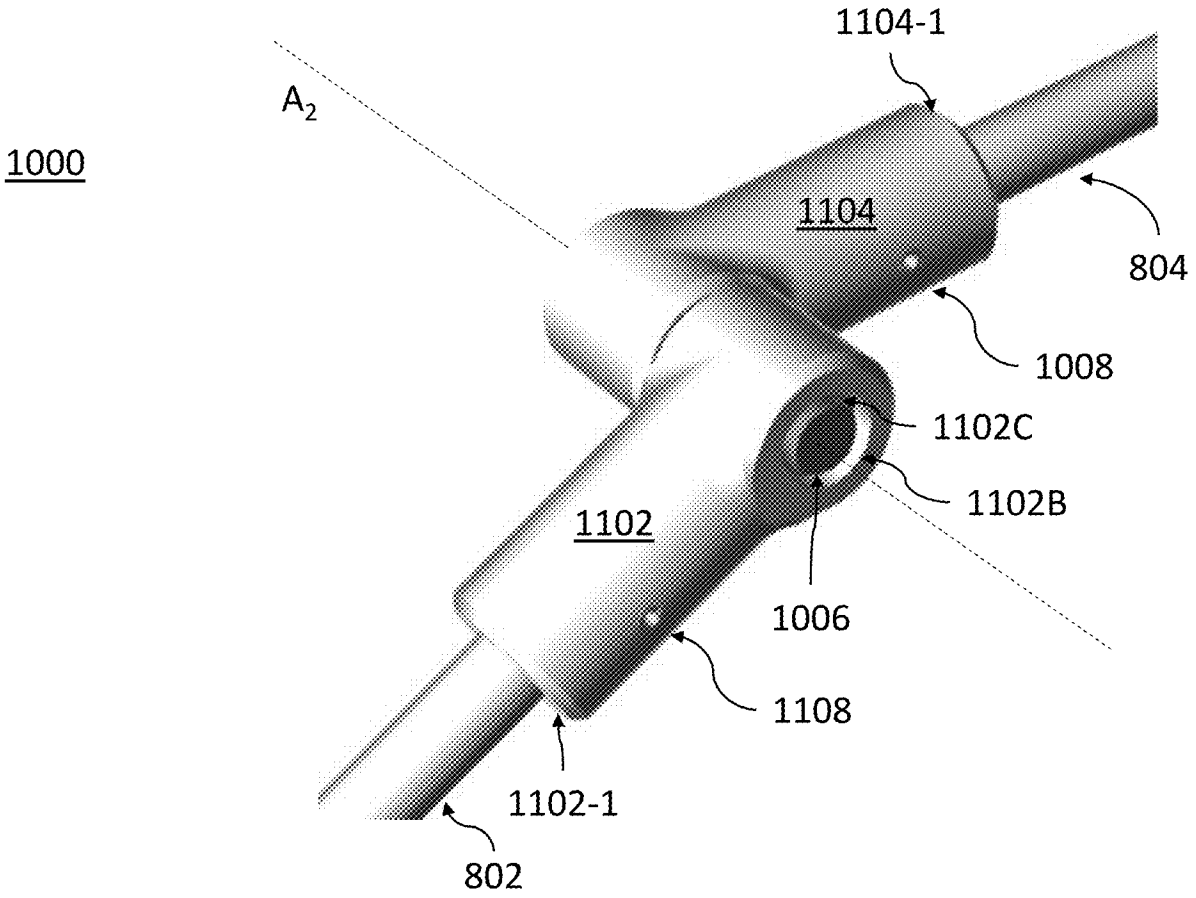
FIG. 11A is a perspective view of the upper joint 1000 of the lower pivoting mechanism 812.
Figure 11B:
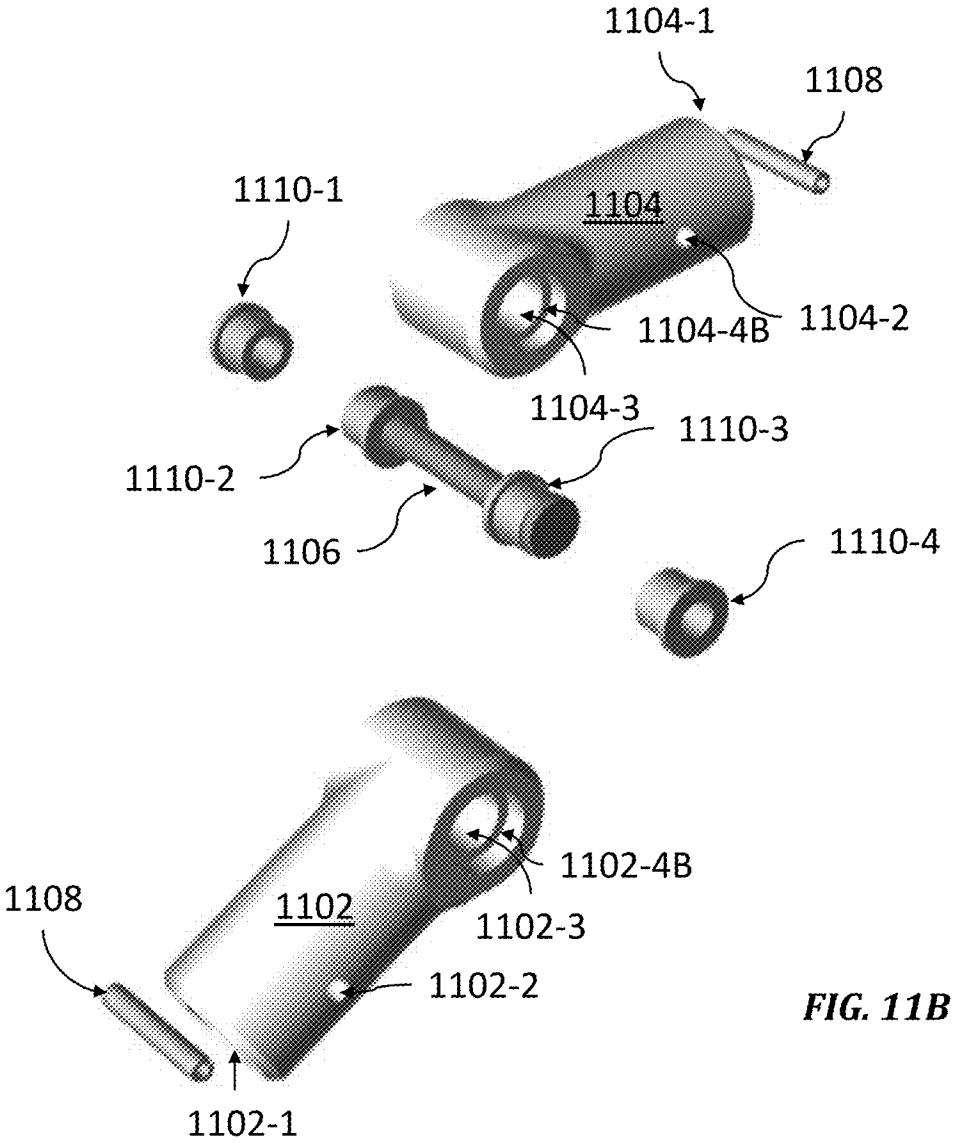
FIGS. 11B and 11C are exploded side perspective views of components comprising the upper joint 1000.
Figure 11C:
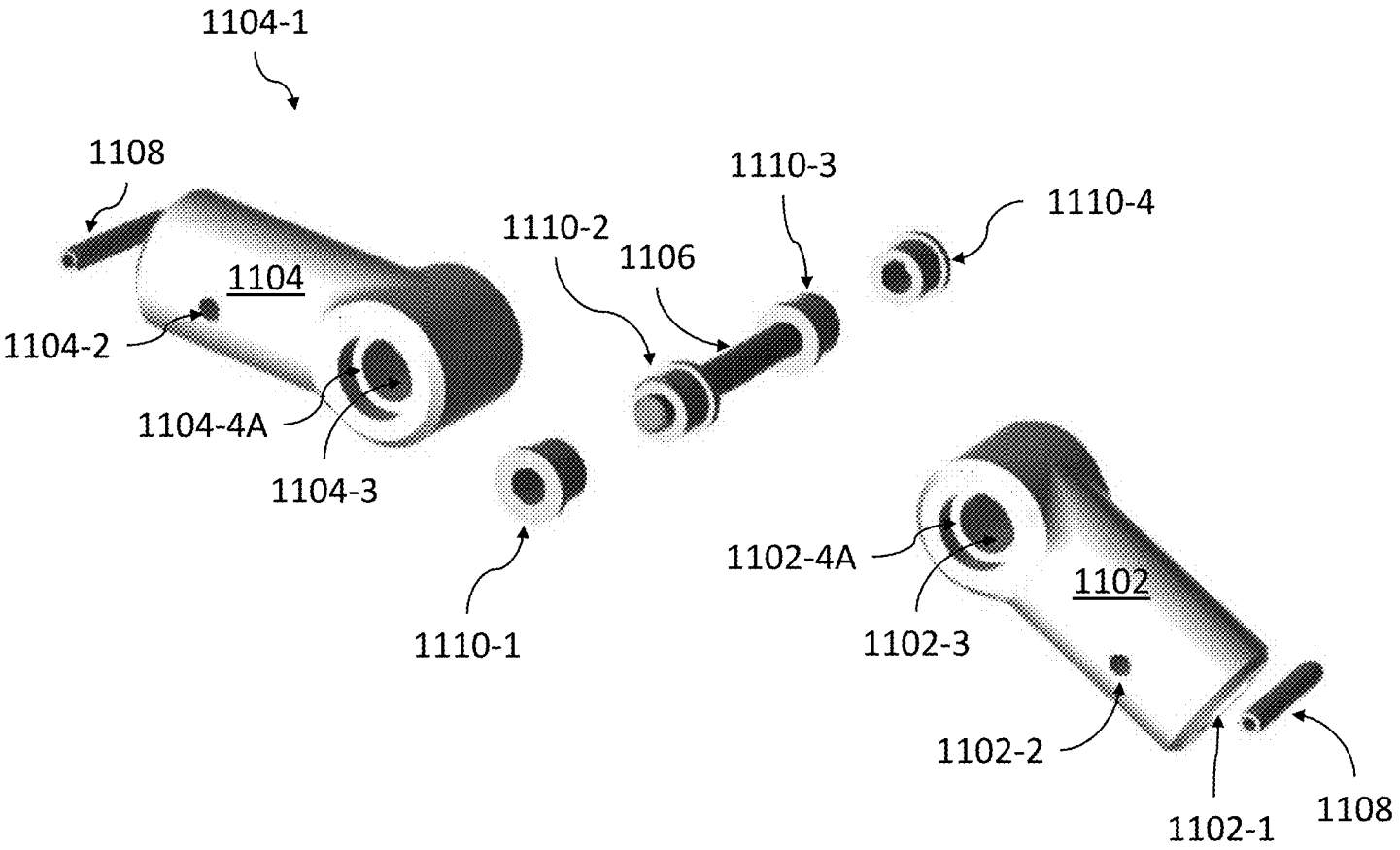

FIG. 11A is a perspective view of the upper joint 1000 of the lower pivoting mechanism 812. FIGS. 11B and 11C are exploded side perspective views of components comprising the upper joint 1000. The upper joint 1000 is formed by a rotational connection, about axis $A_2$, between two rotational couplers 1102 and 1104. Rotational couplers 1102 and 1104 are the same as rotational coupler 1004 described above. Rod 802 connects the lower joint 900 to the upper joint 1000. Rotational coupler 1102 includes a receptacle 1102-1 to receive rod 802 against a stop located therein. A pin 1108 (which is the same as pin 1008) is inserted through an opening 1102-2 in rotational coupler 1102 and rod 802 to secure rod 802 to rotational coupler 1102. Rotational coupler 1102 further includes an annular section that extends through the rotational coupler 1102 in the axial direction $A_2$. Like above, the annular section includes an opening 1102-3 and flanges 1102-4A and 1102-4B. Rotational coupler 1104 includes a receptacle 1104-1 to receive rod 804 against a stop located therein. A pin 1108 is inserted through an opening 1104-2 in rotational coupler 1104 and rod 804 to secure rod 804 to rotational coupler 1104. Rotational coupler 1104 further includes an annular section that extends through the rotational coupler 1102 in the axial direction $A_2$. The annular section includes an opening 1104-3 and flanges 1104-4A and 1104-4B.

To connect rotational couplers 1102 and 1104, a pin 1106 may be inserted through the annular sections thereof. More specifically, a pin 1006 may be inserted through openings 1102-3 and 1104-3. Like above, bushings 1110-1, 1110-2, 1110-3, and 1110-4 are provided and mounted on flanges 1104-4A, 1104-4B, 1102-4A, and 1102-4B, respectively. Having described both the lower and upper joints 900 and 1000 of the lower pivoting mechanism 812, attention will now be directed to the upper pivoting mechanism 814.

Figure 12:
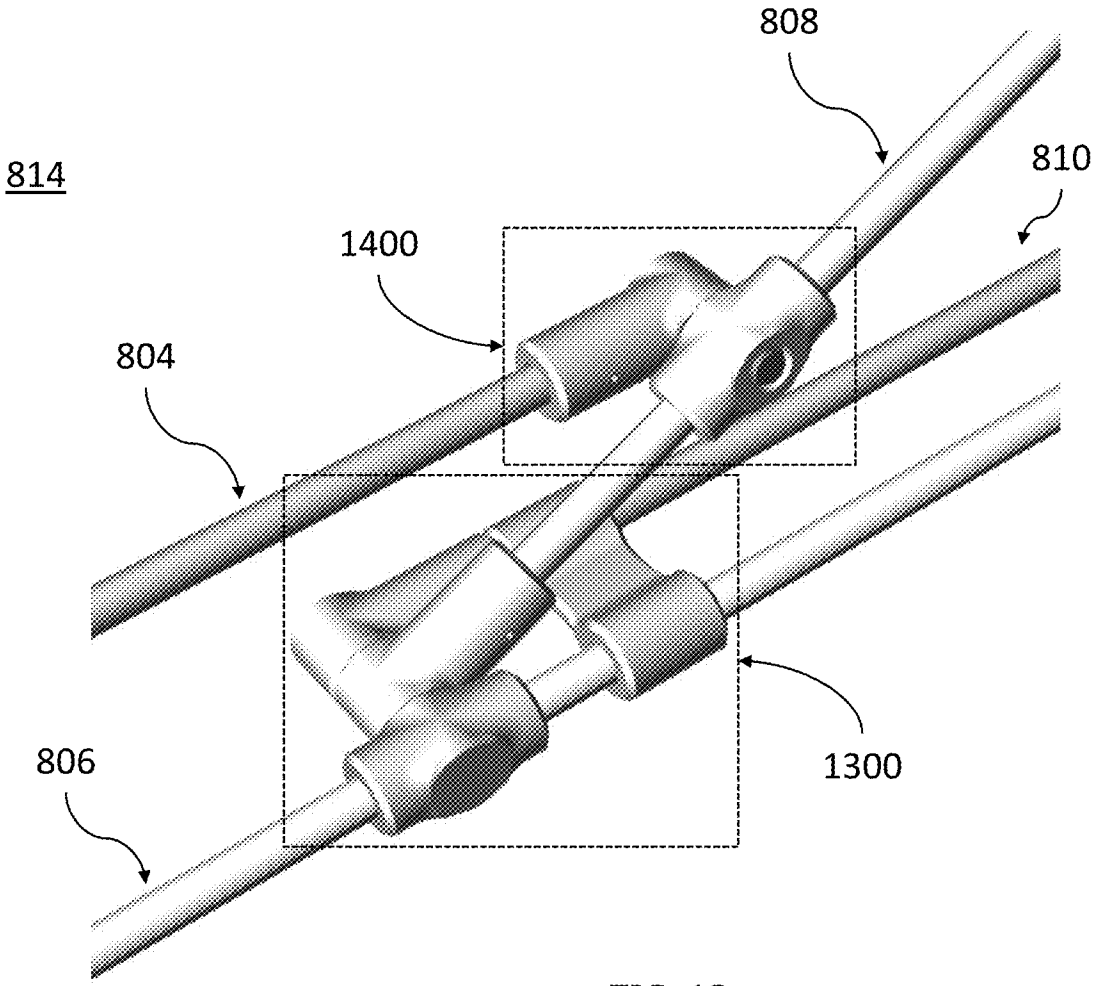
FIG. 12 is a perspective view of the upper pivoting mechanism 814.
Figure 13A:
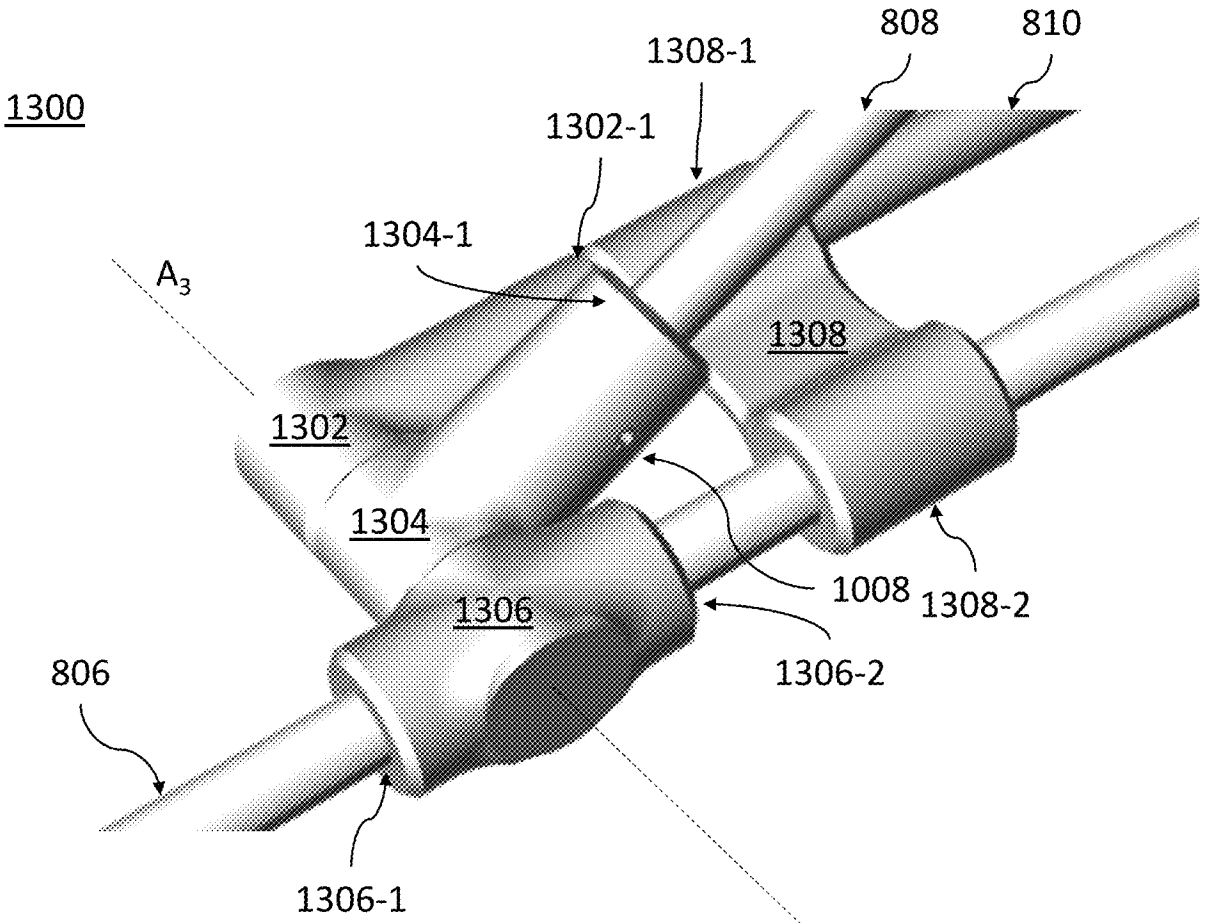
FIG. 13A is a perspective view of the lower joint 1300.
Figure 13B:
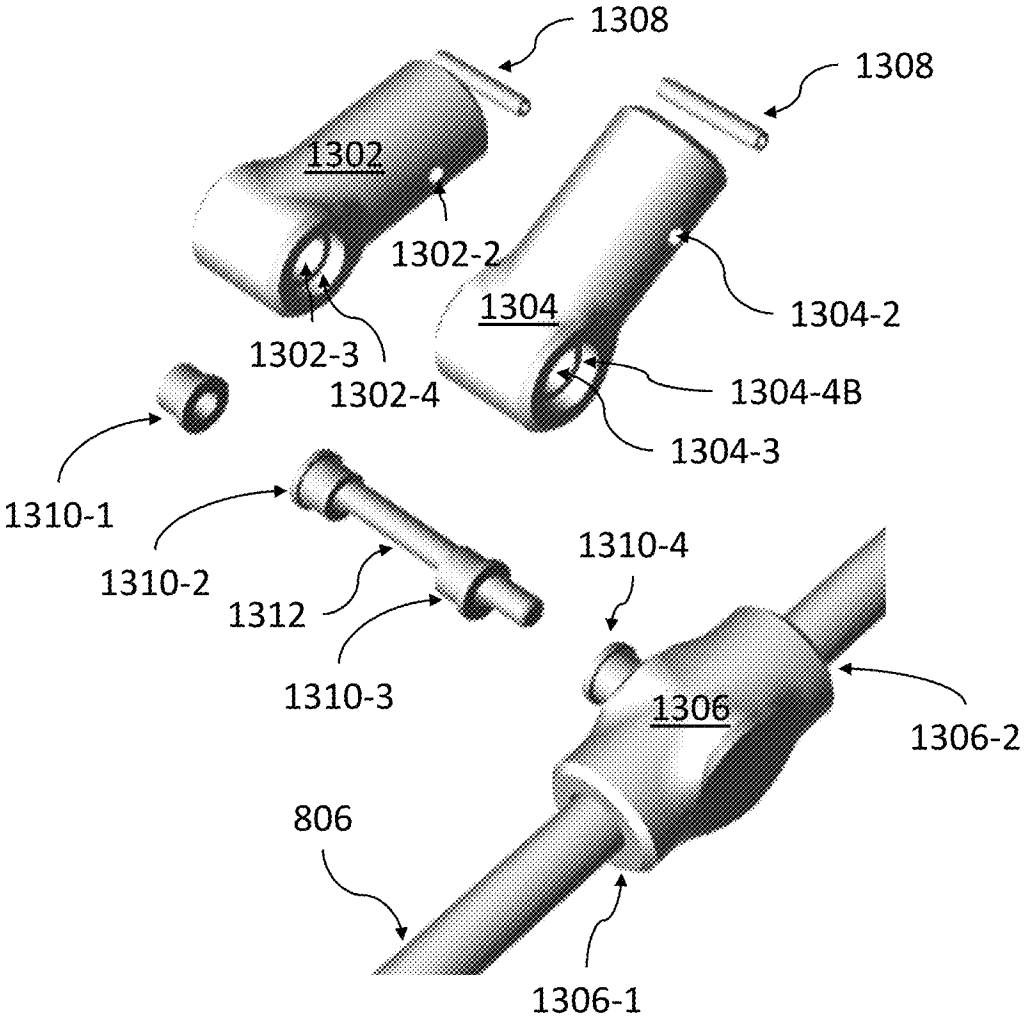
FIGS. 13B and 13C are exploded perspective views of rotational couplers 1302, 1304, and pass-through coupler 1306.
Figure 13C:
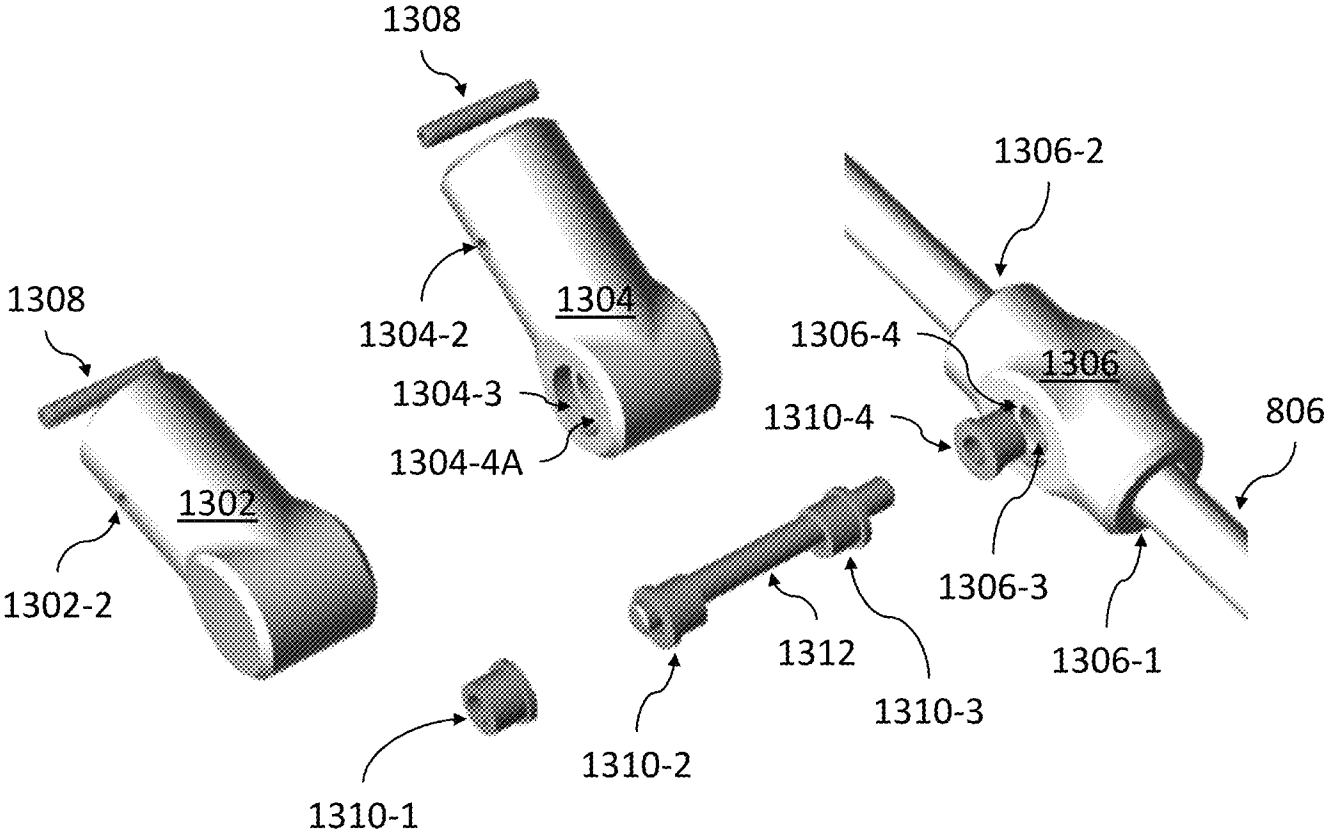

FIG. 12 is a perspective view of the upper pivoting mechanism 814. The upper pivoting mechanism includes a lower joint 1300 and an upper joint 1400, each of which will be discussed below in detail. FIG. 13A is a perspective view of the lower joint 1300. FIGS. 13B and 13C are exploded perspective views of rotational couplers 1302, 1304, and pass-through coupler 1306.

The lower joint 1300 comprises rotational couplers 1302 and 1304, and pass-through coupler 1306. Rod 806 is received by receptacle 1306-1 of the pass-through coupler 1306 and exits the pass-through coupler 1306 through receptacle 1306-2. The pass-through coupler 1306 further includes an opening 1306-3 and a flange 1306-4 on one side extending in a direction of axis ($A_3$) in FIG. 13A. The opening 1306-3 is sized and shaped to accommodate a connecting pin 1312 that allows for a rotational connection between the pass-through coupler 1306 and rotational couplers 1302 and 1304.

Rotational coupler 1304 is disposed between rotational coupler 1302 and the three-way coupler 1306 in the axial direction ($A_3$). Coupler 1304 includes a receptacle 1304-1 that receives rod 808. Like above, rod 808 contacts a stop located within receptacle 1304-1 that aids in alignment of an opening 1304-2 in coupler 1304 and an opening in rod 808 such that a pin 1308 may be inserted through such openings so as to connect rod 808 and coupler 1304. Coupler 1304 includes an opening 1304-3 in the direction of axis $A_3$ that allows connecting pin 1312 to pass through coupler 1304. Coupler 1304 further includes flanges 1304-4A and 1304-4B. Rotational coupler 1302 is disposed adjacent to coupler 1304 on an opposite side of coupler 1304 from the pass-through coupler 1306. Coupler 1302 receives rod 810 at receptacle 1302-1. Like above, rod 810 contacts a stop located within receptacle 1302-1 that aids in alignment of an opening 1302-2 in the coupler 1302 and an opening in rod 810 such that a pin 1308 may be inserted through such openings so as to connect rod 810 and coupler 1302. Coupler 1302 includes an opening 1302-3 in side of coupler 1302 facing coupler 1304 in the axial direction ($A_3$). A connecting pin 1312 may be inserted into opening 1302 and through coaxially located openings in coupler 1304 and 1306 so as to connect couplers 1302, 1304, and three-way coupler 1306. Bushing 1310-1 may be mounted on flange 1302-4 and sized and shaped to receive connecting pin 1312. Similarly, bushings 1310-2 and 1310-3 may be mounted on flanges 1304-4A and 1304-4B, respectively, and sized and shaped to receive connecting pin 1312. Finally, bushing 1310-4 may be mounted on flange 1306-4 and sized and shaped to receive connecting pin 1312.

The lower joint 1300 of the upper pivoting mechanism 814 includes a rod connector 1308 that includes two openings 1308-1 and 1308-2 through which rods 810 and 806 pass, respectively. In one embodiment, rod connector 1308 may include openings for pins that can inserted through rod connector 1308 and into corresponding openings in rods 810 and 806 to prevent rod connector 1308 from sliding. Rod connector 1308 forms a further mechanical connection between rods 810A and 810B to minimize racking thereof when the leg is moved from a folded to unfolded state. Having described the lower joint 1300 of the upper-pivoting mechanism 814, attention will now be directed to the upper joint 1400 of the upper-pivoting mechanism 814.

Figure 14A:
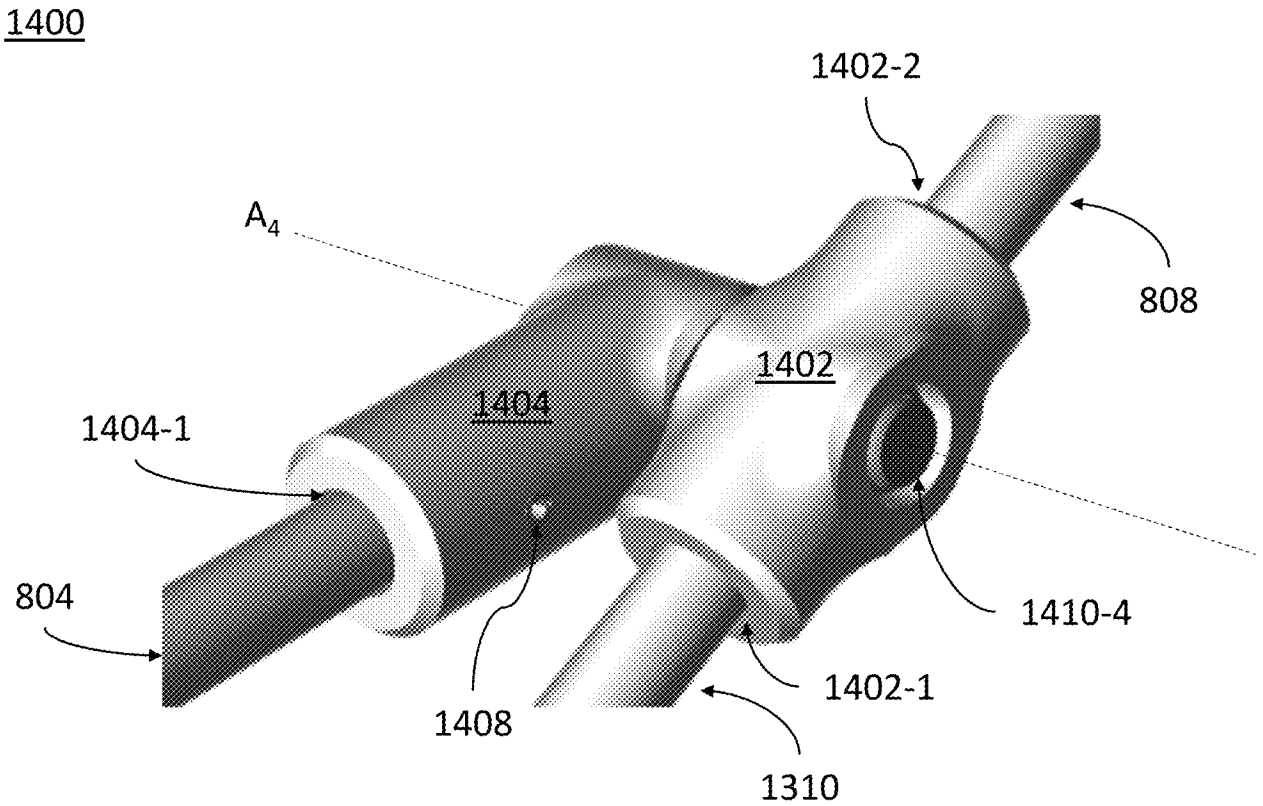
FIG. 14A is a perspective view of the upper joint 1400 of the upper-pivoting mechanism 814.
Figure 14B:
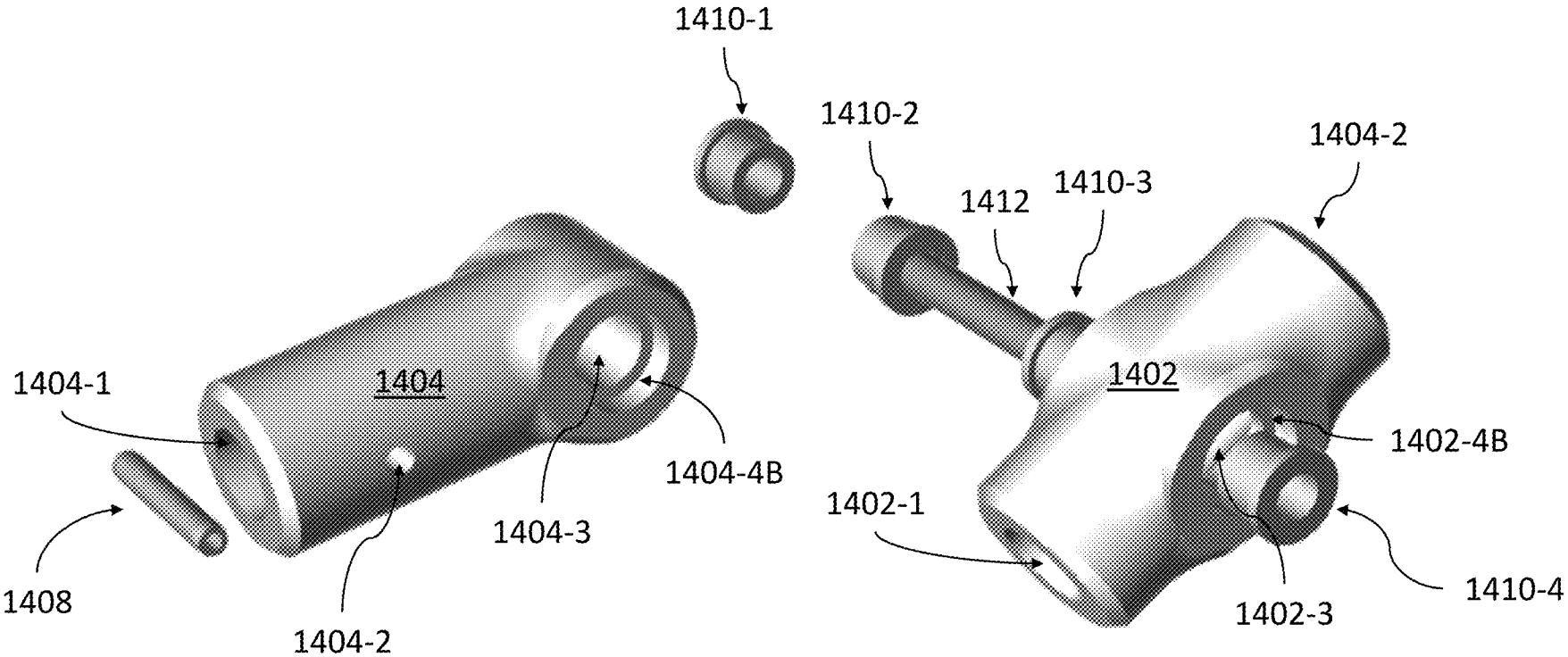
FIGS. 14B and 14C are exploded side perspective views of certain components in the upper joint 1400.
Figure 14C:
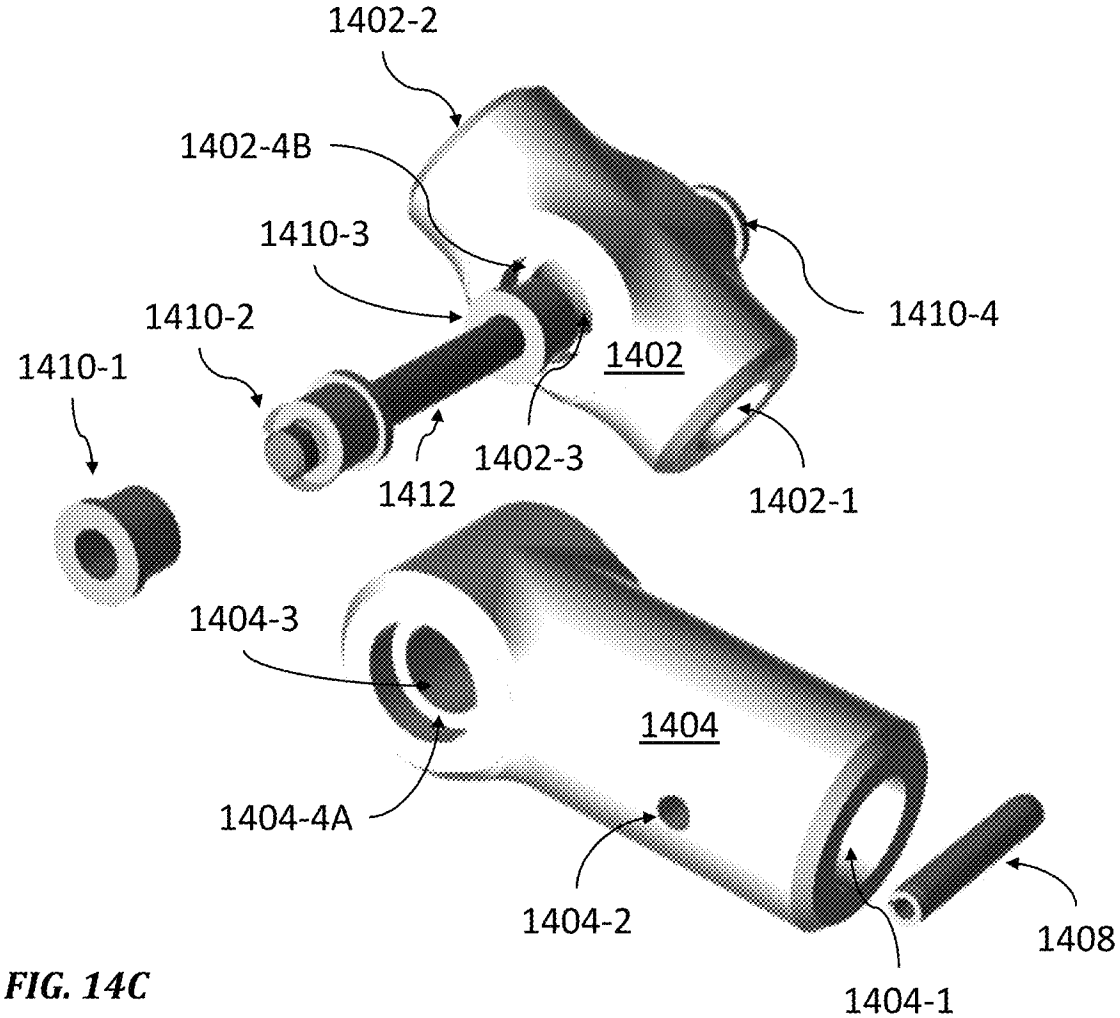

FIG. 14A is a perspective view of the upper joint 1400 of the upper-pivoting mechanism 814. FIGS. 14B and 14C are exploded side perspective views of certain components in the upper joint 1400. The upper joint 1400 comprises a pass-through coupler 1402 and a rotational coupler 1404. FIG. 13B is an exploded side view of the pass-through coupler 1402 and the rotational coupler 1404. FIG. 13C is an exploded side view the pass-through coupler 1402 and the rotational coupler 1404 from an opposite side of that shown in FIG. 13B.

Rotational coupler 1404 includes a receptacle 1404-1 that receives rod 804. Rod 804 may contact a stop located within receptacle 1404-1 that aids in aligning an opening 1404-2 in coupler 1404 and a corresponding opening in rod 804 such that a pin 1408 may be inserted through such openings to create a mechanical connection between rod 804 and coupler 1404. Coupler 1404 further includes an annular section that includes an opening 1404-3 that is coaxial with axis $A_4$. Coupler 1404 further includes flanges 1404-4A and 1404-4B.

Pass-through coupler 1402 includes receptacles 1402-1 and 1402-2 that allow rod 808 to pass through coupler 1402. As discussed above, rod 808 is received by receptacle 1304-1 of coupler 1304 and may contact a stop located therein. When rod 808 is in contact with the stop in coupler 1304, it is positioned such that another opening in rod 808 is coaxial with axis $A_4$ in FIG. 14A and an opening 1402-3 that is also located coaxially with respect to axis $A_4$. The opening in rod 808 and opening 1402-3 are sized and shaped to receive a connecting pin 1412 which may be inserted through a bushing 1410-3 that is mounted on a flange 1402-4B. Connecting pin 1412 is also inserted through bushings 1410-1 and 1410-2 mounted on flanges 1404-4A and 1404-4B, respectively, to create a rotational connection between rotational coupler 1404 and pass-through coupler 1402. Having described the joints 1300 and 1400 comprising the upper pivoting mechanism 814, attention will now directed to the manner in which leg 106 is connected to the top hub 102 and the bottom hub 104.

Figure 15A:
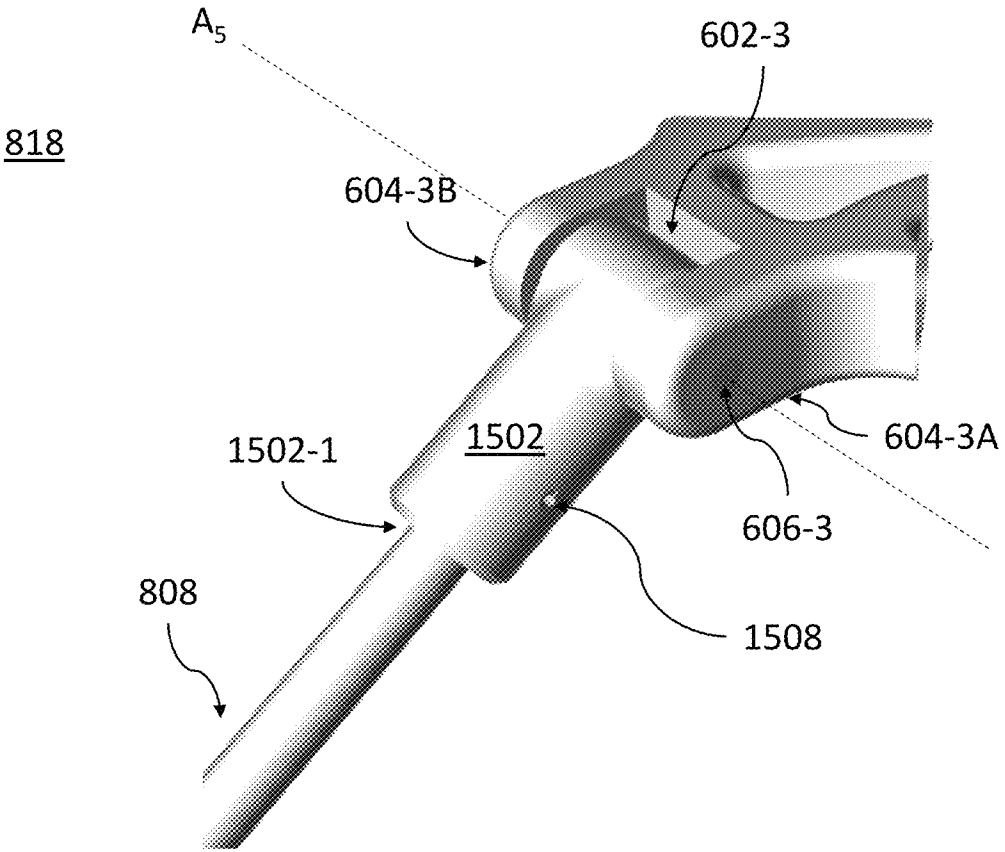
FIG. 15A is a perspective view of a top coupling mechanism 818.
Figure 15B:
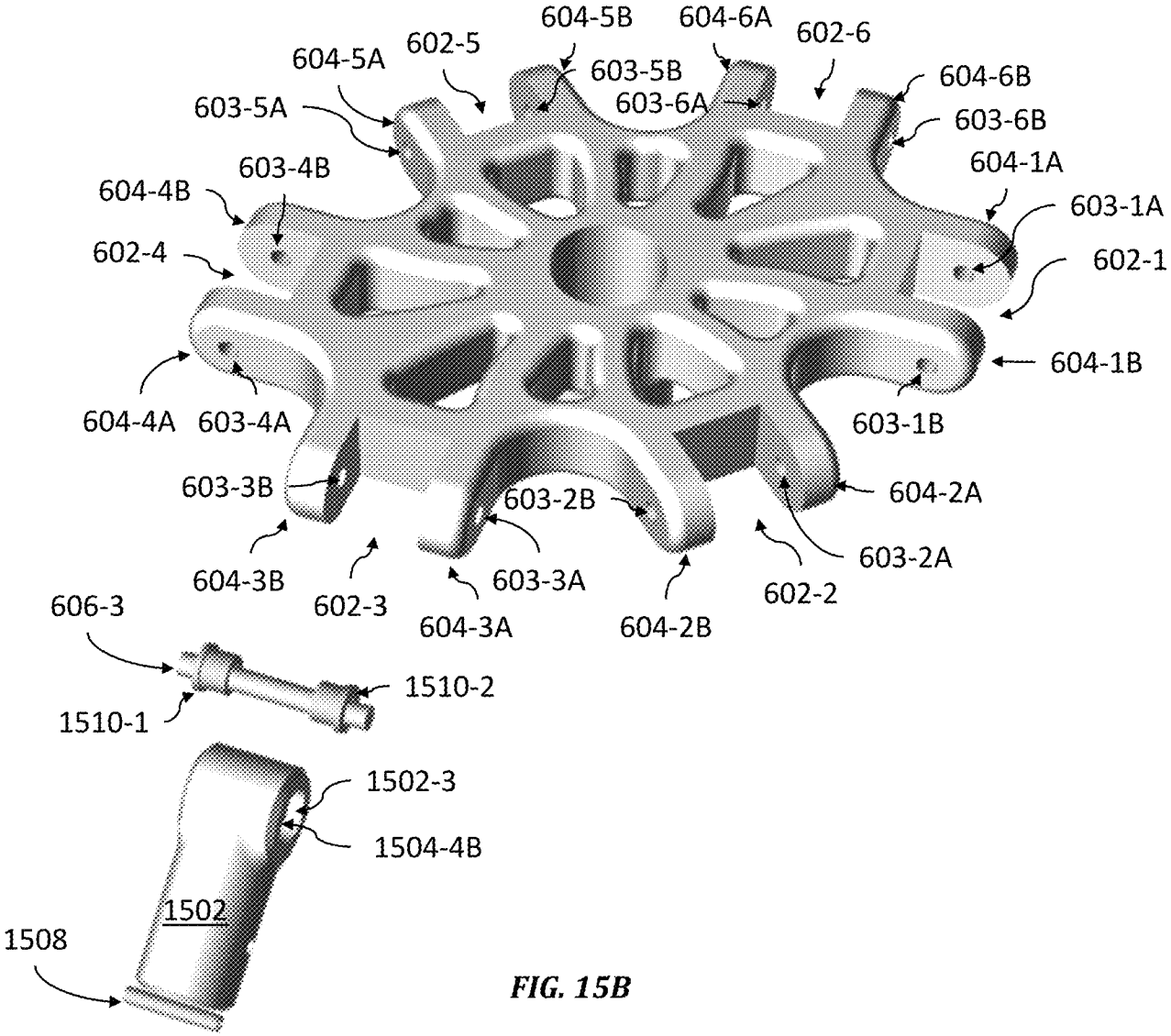
FIG. 15B is an exploded perspective view of a rotational coupler 1502 in relation to top hub 102.
Figure 15C:
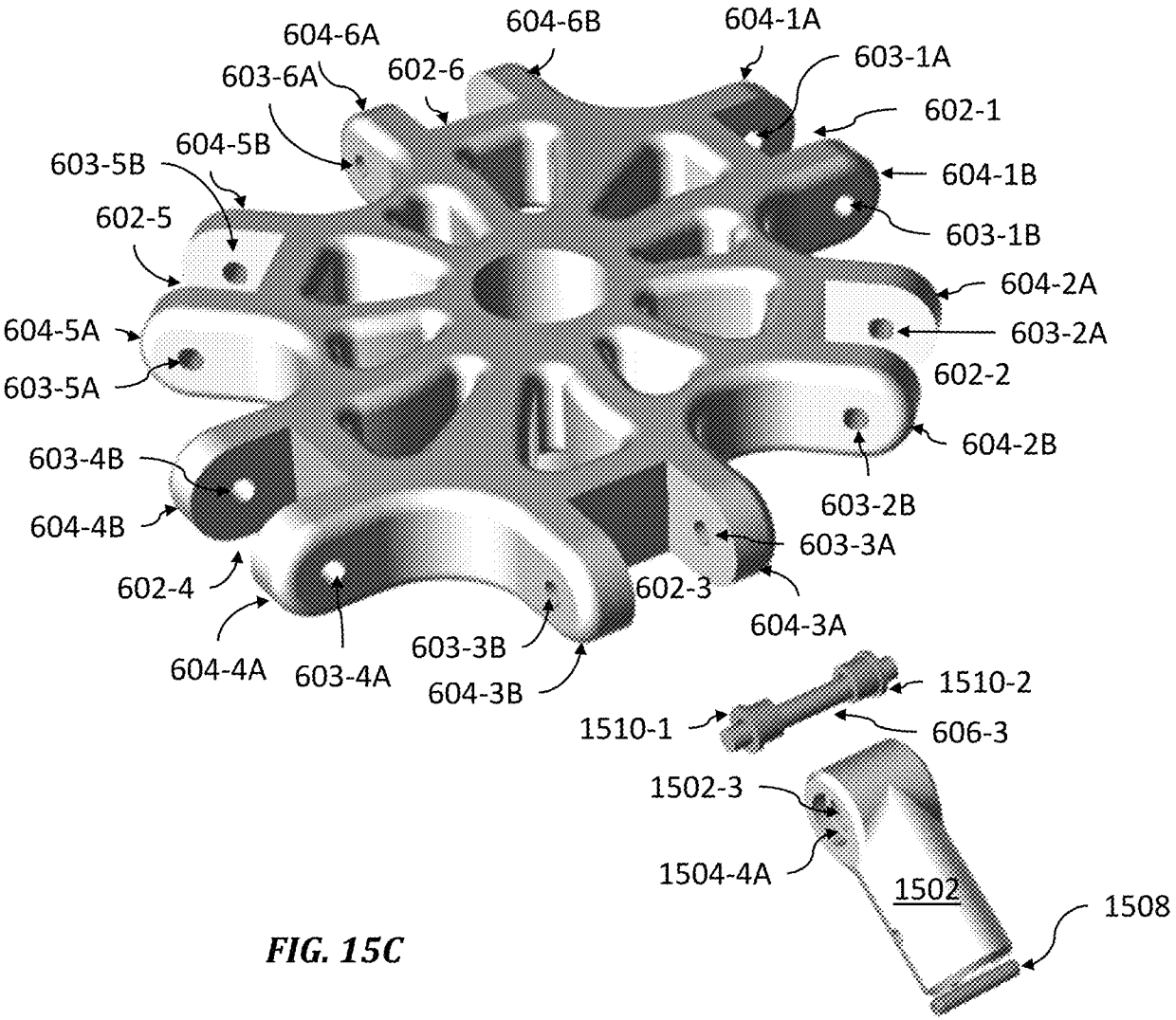
FIG. 15C is an exploded perspective view of rotational coupler 1502 in relation to top hub 102 from the opposite side of that shown in FIG. 15B.

FIG. 15A illustrates the upper coupling mechanism 818 which is an exemplary connection between leg 106 and the top hub 102. FIG. 15B is an exploded perspective view of a rotational coupler 1502 in relation to top hub 102. FIG. 15C is an exploded perspective view of rotational coupler 1502 in relation to top hub 102 from an opposite of that shown in FIG. 15B. Rod 808 of leg 106 is received by receptacle 1502-1 of rotational coupler 1502. Like above, a stop may be provided within receptacle 1502-1 which rod 808 may contact thus aiding in the alignment of openings provided in coupler 1502 and rod 808 through which a pin 1008 is inserted to provide a mechanical connection between rod 808 and coupler 1502. At an opposite end of coupler 1502 from receptacle 1502-1 is an annular section that includes an opening 1502-3 and flanges 1504-4A and 1504-4B. The opening 1502-3 extends from one end of coupler 1502 to the other, in the axial direction $A_5$. Bushings 1510-1 and 1510-2 are provided and may be mounted on flanges 1504-4A and 1504-4B, respectively.

In FIG. 15A, coupler 1502 is disposed within recess 602-3; however, this is merely exemplary. The upper connection between legs 106A-E and recesses 602-1 . . . 602-6, respectively, is the same as that depicted in FIG. 15A. Thus, for brevity, a detailed description of the connection between coupler 1502 and the top hub 102 at recess 602-3 will be provided below, but a detailed description of how the other legs are attached to top hub 102 at the other recesses will be omitted. To connect coupler 1502 to the top hub 102, a connecting pin 606-3 is inserted via press fitting through: opening 603-3A, bushing 1510-2, opening 1502-3, bushing 1510-1, and opening 603-3B. Having described the connection between an exemplary leg 106 and the top hub 102, attention will now be directed to the connection between the exemplary leg 106 and the bottom hub 104 via the lower coupling mechanism 816.

Figure 16A:
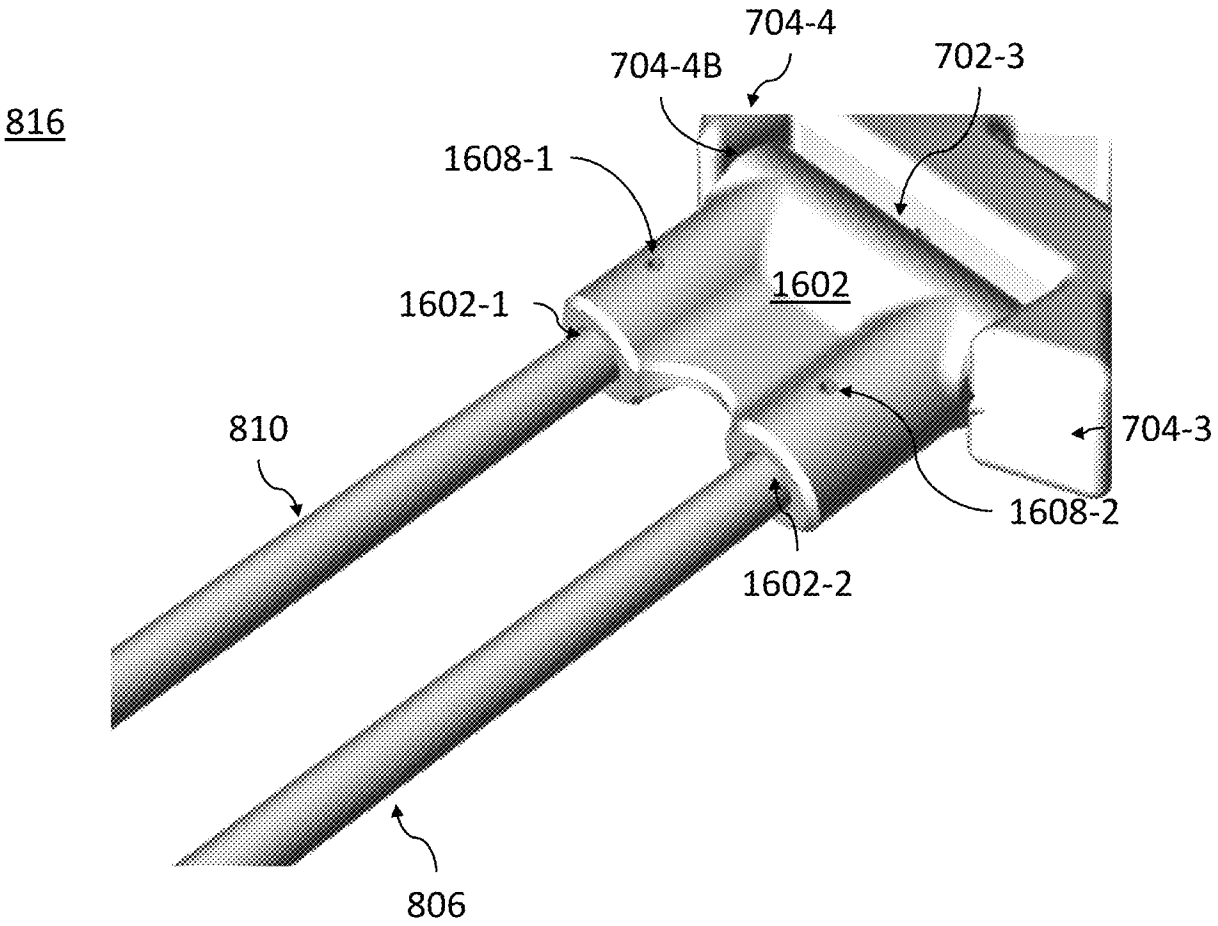
FIG. 16A is a perspective view of a lower coupling mechanism 816.
Figure 16B:
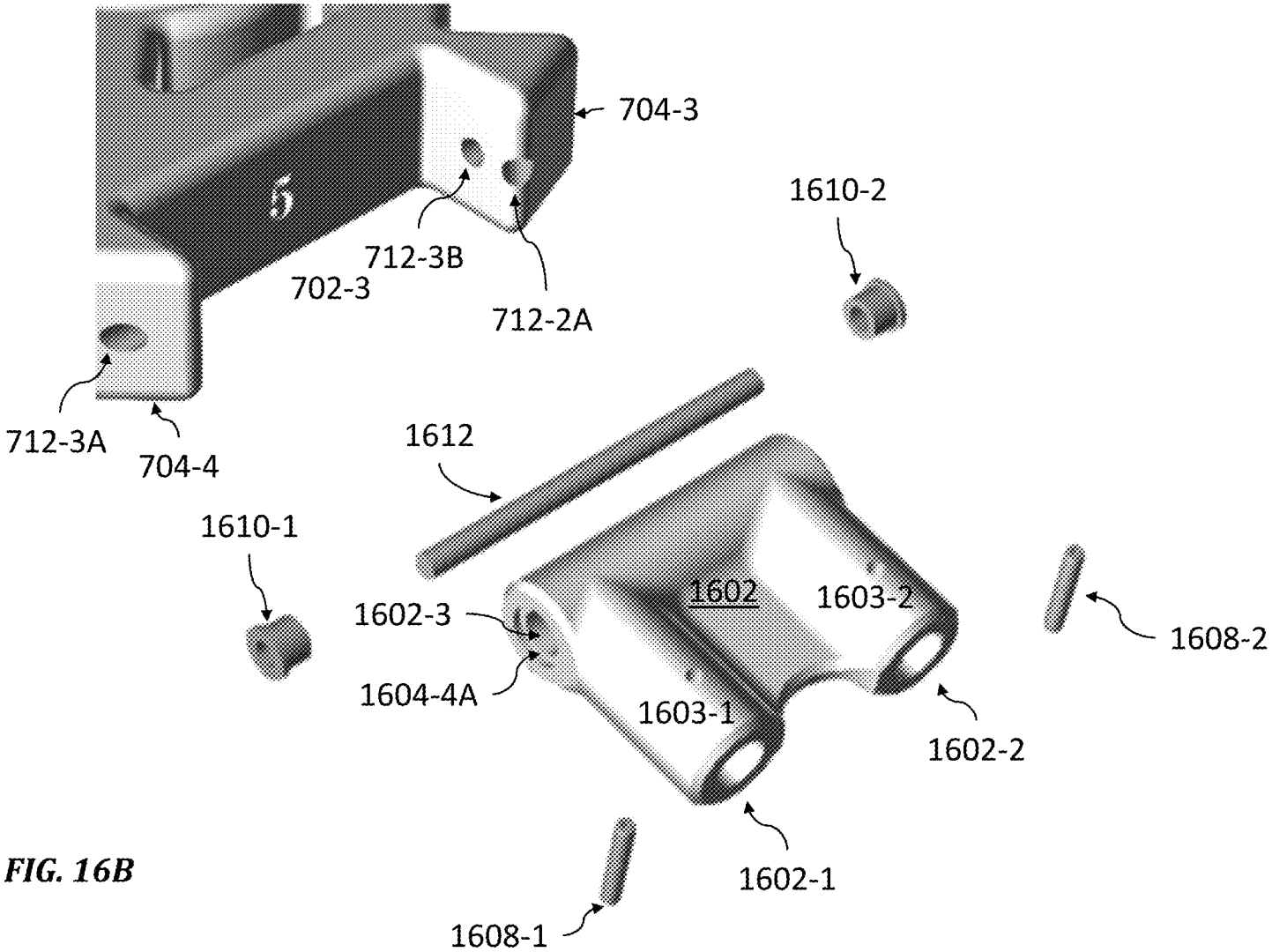
FIGS. 16B and 16C are exploded side perspective views of the lower coupling mechanism 816.
Figure 16C:
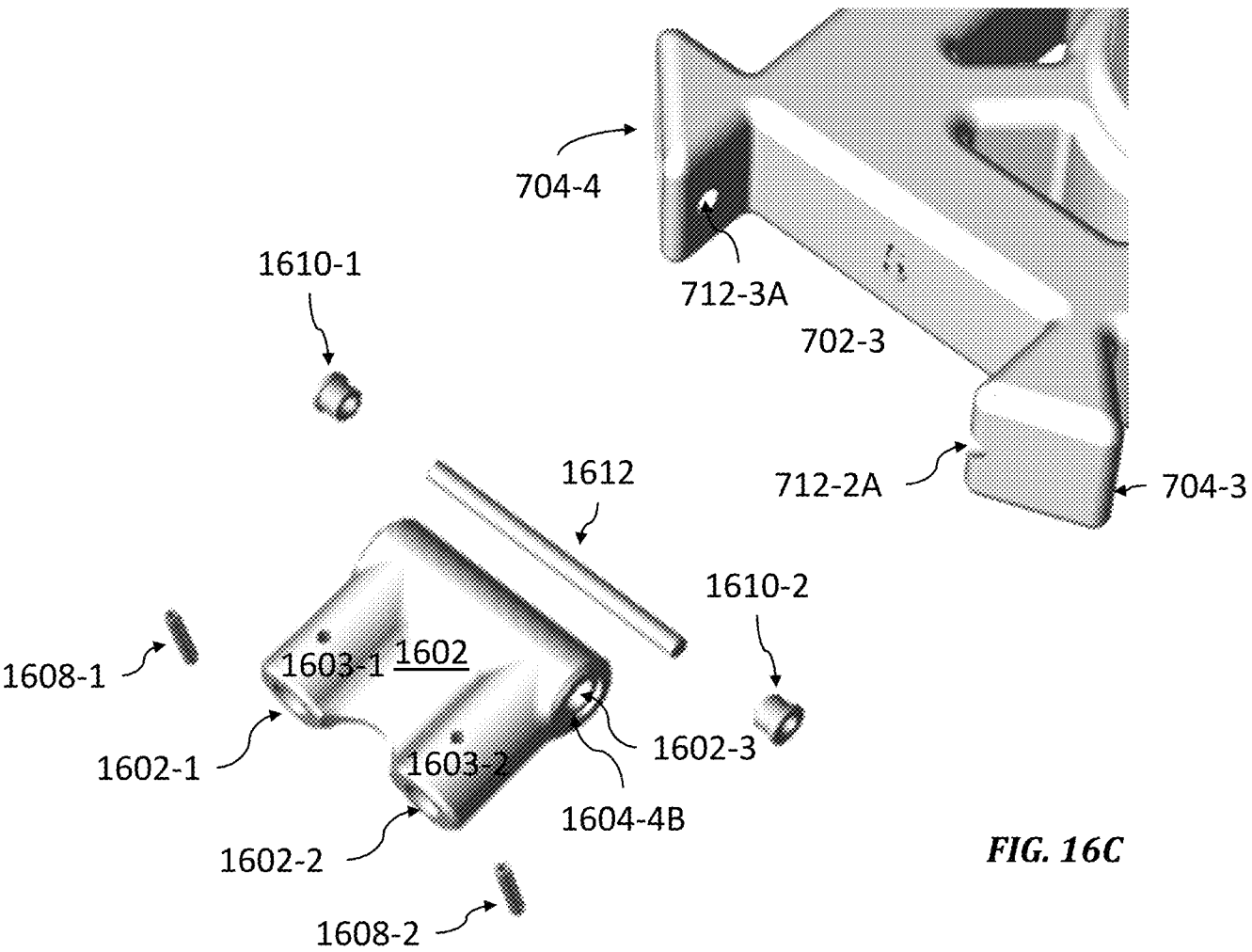

FIG. 16A is a perspective view of a lower coupling mechanism 816. FIGS. 16B and 16C are exploded side perspective views of the lower coupling mechanism 816. Rods 810 and 806 are received in receptacles 1602-1 and 1602-2 of a two-receptacle rotational coupler 1602. Like above, receptacles 1602-1 and 1602-2 may have stops therein that rods 810 and 806 contact to bring openings 1603-1 and 1603-2 into alignment with openings on rods 810 and 806, respectively. This allows for pins 1608-1 and 1608-2 to be inserted through openings 1603-1 and 1603-2 and rods 810 and 806, respectively, to secure rods 810 and 806 to the two-receptacle rotational coupler 1602. The two-receptacle rotational coupler 1602 also includes an opening 1602-3 and flanges 1604-4A and 1604-4B. In FIGS. 16A-C, the two-receptacle rotational coupler 1602 is disposed within recess 702-3. However, this is merely exemplary. Like above, the lower coupling mechanism 816 is the same for each of legs 106A-E, and thus the connection between the lower coupling mechanism 816 and any one of the recesses 702-1 . . . 702-6 is the same as the connection illustrated in FIGS. 16A-C. To connect the two-receptacle rotational coupler 1602 to the lower hub 104, the two-receptacle rotational coupler 1602 is placed within recess 702-3 such that opening 1602-3 is coaxial with openings 712-3A and 712-3B formed in protrusions 704-4 and 704-3, respectively. A connecting pin 1612 may then be inserted through opening 712-3A, bushing 1610-1 (which is mounted to flange 1604-4A), opening 1602-3, bushing 1610-2 (which is mounted to flange 1604-4B) and finally opening 712-3B. This connection now provides for rotational movement between the lower hub 104 and the two-receptacle rotational coupler 1602.

Figure 17:
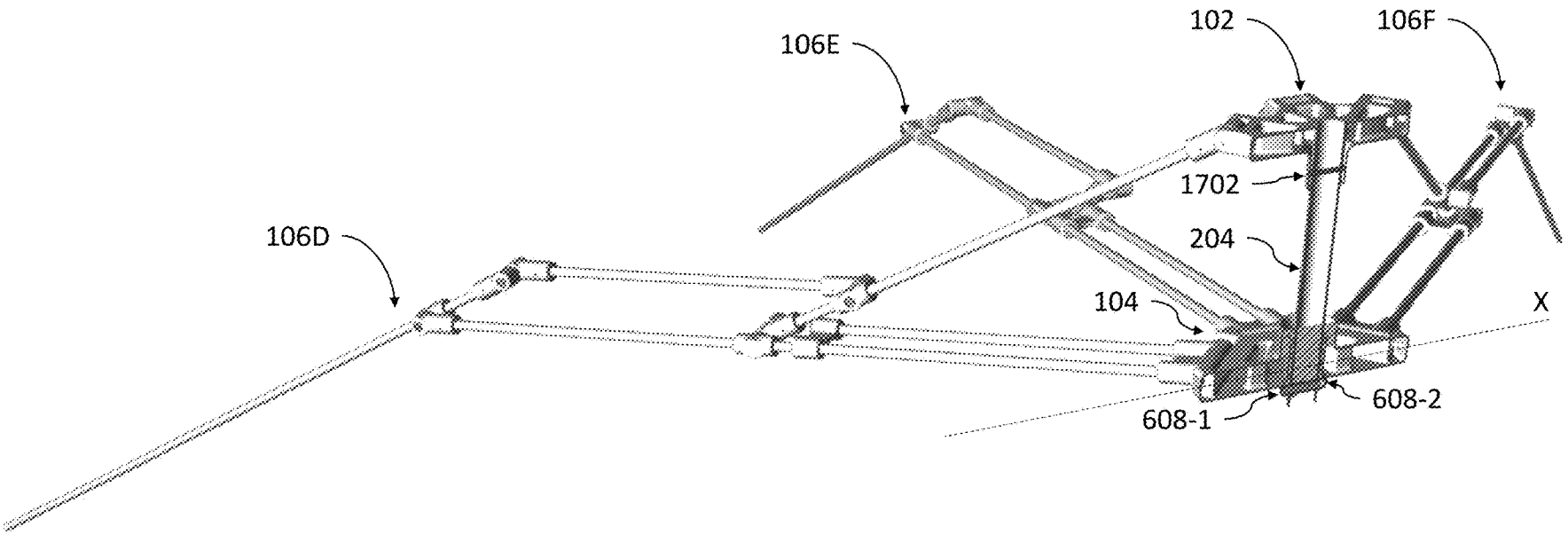
FIG. 17 is a cross-sectional view of structure 100 taken along the x-axis in FIG. 2D.

FIG. 17 is a cross-sectional view of structure 100 taken along the x-axis in FIG. 2D which shows the operation of pin 1702 and pins 608-1 and 608-2 in the extended state.

Described above is a six-legged structure 100 that can be rapidly deployed by an individual with hardly any effort. However, the invention is not limited to a six-legged embodiment. FIG. 18 shows another structure 1800 that employs four legs 1806A-D. Besides the number of legs, the principal difference between the six-legged structure 100 and the four-legged structure 1800 is that the number of recesses in the top hub 1802 and the bottom hub 1804 are correspondingly decreased. Legs 1806A-D are the same as leg 106 described above in detail. Accordingly, a detailed description thereof is currently omitted. Rod 1808 is the same as rod 204 described above. As one of ordinary skill will recognize, an additional leg may be removed from the design of structure 1800 and yet still function since three points is all that is necessary to define a plane of stability. On the other hand, additional recesses may be added to the top hub and the bottom hub to accommodate more than six legs, should such a configuration be desirable.

As one of ordinary skill will appreciate, a covering may be provided to shelter a person inside structure 100 (or structure 1800) from the elements of view of others people or animals. As one of ordinary skill will also appreciate, there are a multitude of ways in which a cover may be connected to structure 100 or 1800. In fact, in some instances, it may not be necessary to connect the covering to structure 100. If the covering is large enough, is may simply be placed on top of structure 100 to shield those within structure 100 from view. Alternatively, the covering may have loops formed around its periphery that are sized and shaped to receive a distal end of legs 106A-E, relative to the hubs 102 and 104. The covering may also have loops or snaps that can be secured around legs 106A-E to hold it in place. Covering may also be provided with a door or windows of any shape or size in order to give those within structure 100 a means of egress or observation.

As one of ordinary skill in the art will appreciate, the dimensions of the legs 106A-E and the distance from the top hub 102 to the pins 608-1 and 608-2 determine the size of the overall structure. Said another way, if a covering were provided over structure 100 or 1800, the enclosed space would be defined by the dimensions of the legs 106A-E and the distance from the top hub 102 to pins 608-1 and 608-2. The legs 106A-E and the distance from the top hub 102 to pins 608-1 and 608-2 may be set during manufacturing to provide for a certain enclosed volume once a covering is provided. That volume can correspond to space for single, double, or triple occupancy—or even more. In an exemplary embodiment, structures 100 or 1800, when provide with a suitable covering may be used to cover a parapet or a foxhole that one or more users may occupy. In that embodiment, the apex of the structure, with a covering provided is approximately 30 inches above the ground. To make structures 100 and 1800 easy for an individual to transport, their length when folded is preferably 36 inches. However, these values are merely exemplary and a person of ordinary skill in the art would recognize that a wide range of dimensional values may be selected to meet the intended use of structures 100 and 1800 with departing from the scope of the invention.

While various example embodiments of the invention have been described above, it should be understood that they have been presented by way of example, and not limitation. It is apparent to persons skilled in the relevant art(s) that various changes in form and detail can be made therein. Thus, the disclosure should not be limited by any of the above described example embodiments, but should be defined only in accordance with the following claims and their equivalents.

In addition, it should be understood that the figures are presented for example purposes only. The architecture of the example embodiments presented herein is sufficiently flexible and configurable, such that it may be utilized and navigated in ways other than that shown in the accompanying figures.

Further, the purpose of the Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The Abstract is not intended to be limiting as to the scope of the example embodiments presented herein in any way. It is also to be understood that the procedures recited in the claims need not be performed in the order presented.

What is claimed is:

1. An apparatus, comprising:

a first hub comprising a first plurality of recesses;

a second hub comprising a second plurality of recesses and an alignment guide;

a plurality of legs, wherein each leg is connected to the first hub and the second hub; and a rod connected to the first hub and comprising a plurality of pins that are movable between an extended state and a retracted state, wherein in the extended state the plurality of pins protrude from the rod, and in a retracted state the plurality of pins are retracted within the rod, wherein the first hub is movable relative to the second hub between a first state in which the rod is disposed above the alignment guide in an axial direction defined by an opening in the alignment guide and a second state in which a portion of the rod comprising the plurality of pins is located below the alignment guide in the axial direction, wherein each of the plurality of legs includes a lower pivoting mechanism (LPM) and an upper pivoting mechanism (UPM), wherein the upper pivoting mechanism includes a UPM lower joint and a UPM upper joint, and wherein the UPM lower joint comprises a first UPM rotational coupler, a second UPM rotational coupler, a first UPM pass-through coupler, and a UPM connecting pin, wherein the first UPM rotational coupler, the second UPM rotational coupler, and the first UPM pass-through coupler are connected by the UPM connecting pin to establish a rotational connection between the first UPM rotational coupler, the second UPM rotational coupler, and the first UPM pass-through coupler about an axis defined by the UPM connecting pin, and wherein the second UPM rotational coupler is disposed between the first UPM rotational coupler and the first UPM pass-through coupler in an axial direction defined by the UPM connecting pin.

2. The apparatus of claim 1, wherein the lower pivoting mechanism includes an LPM lower joint and an LPM upper joint.

3. The apparatus of claim 2, wherein the first LPM lower joint comprises a first LPM rotational coupler, a first LPM pass-through coupler, and a LPM connecting pin, and wherein the first LPM rotational coupler and the first LPM pass-through coupler are connected by the LPM connecting pin to establish a rotational connection between the first LPM rotational coupler and the first LPM pass-through coupler about an axis defined by the LPM connecting pin.

4. The apparatus of claim 3, wherein the LPM upper joint comprises a second LPM rotational coupler, a third LPM rotational coupler, and another LPM connecting pin, and wherein the second LPM rotational coupler and third LPM rotational coupler are connected by the other LPM connecting pin to establish a rotational connection between the second LPM rotational coupler and third LPM rotational coupler about an axis defined by the other LPM connecting pin.

5. The apparatus of claim 4, wherein a leg rod passes through the first LPM pass-through coupler and is received by a receptacle of the second LPM rotational coupler.

6. The apparatus of claim 1, wherein the UPM upper joint comprises a third UPM rotational coupler, a second UPM pass-through coupler, and another UPM connecting pin, and wherein the third UPM rotational coupler and the second UPM pass-through coupler are connected by the other UPM connecting pin to establish a rotational connection between the third UPM rotational coupler and the second UPM pass-through coupler about an axis defined by the other UPM connecting pin.

7. The apparatus of claim 6, wherein the second UPM rotational coupler of the UPM lower joint is connected to the second UPM pass-through coupler of the UPM upper joint by another rod.

8. The apparatus of claim 7, wherein the other rod is connected to a fourth rotational coupler at an opposite end of the other rod from the second UPM rotational coupler.

9. The apparatus of claim 8, wherein the fourth rotational coupler is connected to a recess of the first plurality of recesses formed in the first hub by a third connecting pin to establish a rotational connection between the fourth rotational coupler and the top hub about an axis defined by the third connecting pin.

10. The apparatus of claim 1, wherein the first UPM rotational coupler of the UPM lower joint is connected to a two-receptacle rotational coupler by another rod, wherein the first UPM pass-through coupler of the UPM lower joint and the two-receptacle rotational coupler are connected by a third rod, and wherein the third rod is also connected to a first LPM rotational coupler of an LPM lower joint of the lower pivoting mechanism.

11. The apparatus of claim 10, wherein the two-receptacle rotational coupler is connected to a corresponding recess of the second plurality of recesses in the second hub by a connecting pin to establish a rotational connection between the two-receptacle rotational coupler and the second hub.

* * * * *